US010564595B2

(12) United States Patent
Hanayama et al.

(10) Patent No.: US 10,564,595 B2
(45) Date of Patent: Feb. 18, 2020

(54) CARTRIDGE UNIT

(71) Applicant: CANON KABUSHIKI KAISHA, Tokyo (JP)

(72) Inventors: Shimpei Hanayama, Matsudo (JP); Ryota Yasui, Tokyo (JP); Hiroki Takayama, Yashio (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/989,303

(22) Filed: May 25, 2018

(65) Prior Publication Data

US 2018/0348697 A1 Dec. 6, 2018

(30) Foreign Application Priority Data

Jun. 2, 2017 (JP) ..... 2017-110448

(51) Int. Cl.
*G03G 21/16* (2006.01)
*G03G 15/00* (2006.01)

(52) U.S. Cl.
CPC ..... *G03G 21/1671* (2013.01); *G03G 15/751* (2013.01); *G03G 21/1633* (2013.01)

(58) Field of Classification Search
CPC ..... G03G 21/185; G03G 21/1842; G03G 21/1896; G03G 21/1828; G03G 21/1821
See application file for complete search history.

(56) References Cited

U.S. PATENT DOCUMENTS 8,055,154 B2 11/2011 Iikura et al.
2016/0209803 A1 7/2016 Katayama

FOREIGN PATENT DOCUMENTS

JP 2016-130816 A 7/2016

OTHER PUBLICATIONS

Co-pending U.S. Appl. No. 15/989,312.

*Primary Examiner* — Walter L Lindsay, Jr.
*Assistant Examiner* — Arlene Heredia
(74) *Attorney, Agent, or Firm* — Venable LLP

(57) ABSTRACT

A cartridge unit includes a first drum cartridge, a first cover member, a stopper, and a first cover erroneous insertion blocking portion. The first cover member is removably attached with the first drum cartridge and configured to be compatible in shape with a first holding portion of a first apparatus body so that the first cover member is guided and held by the first holding portion. The first cover erroneous insertion blocking portion is configured to permit the first cover member to be guided by the first holding portion by a first distance from a first insertion slot portion and to block a second cover member, which is removably attached with a second drum cartridge functionally different from the first drum cartridge, to be guided by the first holding portion in a range exceeding a second distance shorter than the first distance from the first insertion slot portion.

7 Claims, 22 Drawing Sheets

CARTRIDGE UNIT

BACKGROUND OF THE INVENTION

Field of the Invention

The present disclosure relates to a cartridge unit utilizing an electro-photographic or electrostatic recording photosensitive member unitized as a cartridge.

Description of the Related Art

Hitherto, an electro-photographic image forming apparatus is configured to visualize an image by developing an electrostatic latent image formed on an image bearing member such as a photosensitive drum by resin containing coloring matters and others. Popular one among such image forming apparatuses is an image forming apparatus configured to unitize a photosensitive drum, i.e., a photosensitive member, as a cartridge, to enable the cartridge to be mounted to an apparatus body as a process cartridge or as a drum cartridge and to enable a user of the apparatus to replace the cartridge as an image forming member. It is noted that the process cartridge or the drum cartridge in which the photosensitive drum is unitized as the cartridge will be called collectively as a drum cartridge.

In order to improve workability in replacing such drum cartridge, Japanese Patent Application Laid-open No. 2016-130816 has proposed an image forming apparatus configured to mount the drum cartridge as follows. A new drum cartridge to be mounted to the image forming apparatus is attached with a cover member protecting a photosensitive drum. In a case where the drum cartridge is inserted into an apparatus body by a first distance, a stopper of the cover member butts against the apparatus body. Then, the cover member cannot be inserted further and is held by being engaged with the apparatus body. The cover member and the apparatus body are provided respectively with guide portions guiding and slidably moving the drum cartridge. Because the cover member is engaged with and held by the apparatus body, the guide portion of the cover member side matches with the guide portion of the apparatus body side. Then, by being pushed into the apparatus body side in this condition by a user, the drum cartridge held by the cover member is passed from the guide portion of the cover member side to the guide portion of the apparatus body side and is finally mounted to the apparatus body. After mounting the drum cartridge to the apparatus body, the user takes the cover member out of the apparatus body. This arrangement makes it possible to suppress an unnecessary exposure of the photosensitive drum and a contact between the photosensitive drum and the apparatus body during the drum cartridge replacing works because the drum cartridge is covered by the cover member during the drum cartridge replacing works.

By the way, as for the drum cartridge of this sort, there is a case where cover members identical in shape are commonly used for a drum cartridge compatible with an image forming apparatus of predetermined specification and for a drum cartridge compatible with an image forming apparatus of specification different from the abovementioned predetermined specification in order to cut cost or the like. However, the image forming apparatus of Japanese Patent Application Laid-open No. 2016-130816 described above has a possibility of mounting a drum cartridge not compatible with the specification of the image forming apparatus to its apparatus body if the shape of the cover member is identical and the drum cartridge can be mounted. In a case where the user erroneously inserts the drum cartridge incompatible with the specification of the image forming apparatus into its apparatus body, no normal operation can be executed, thus deteriorating usability of the image forming apparatus.

Accordingly, the present disclosure aims at providing a cartridge unit that is enabled to block a drum cartridge incompatible with specification of the apparatus body from being inserted into the apparatus body.

SUMMARY OF THE INVENTION

According to one aspect of the present invention, a cartridge unit includes a first drum cartridge functionally compatible with a first apparatus body and comprising a photosensitive drum for forming an image, the first drum cartridge being configured to be compatible in shape with a first guide portion of the first apparatus body so that the first drum cartridge is capable of inserting into the first apparatus body in an insert direction and of being pulled out of the first apparatus body in a pull-out direction opposite to the insert direction, a first cover member removably attached with the first drum cartridge and configured to shade the photosensitive drum, the first cover member being configured to be compatible in shape with a first holding portion of the first apparatus body so that the first cover member is guided and held by the first holding portion, a stopper provided on the first cover member and configured to restrict the first cover member from being inserted beyond a first distance from a first insertion slot portion of the first apparatus body, and a first cover erroneous insertion blocking portion configured to permit the first cover member to be guided by the first holding portion by the first distance from the first insertion slot portion and to block a second cover member, which is removably attached with a second drum cartridge functionally different from the first drum cartridge and is compatible in shape with the first holding portion, to be guided by the first holding portion in a range exceeding a second distance shorter than the first distance from the first insertion slot portion. The first cover member is compatible in shape with a second holding portion of a second apparatus body with which the second drum cartridge is functionally compatible, and is blocked by a second cover erroneous insertion blocking portion if the first cover member is erroneously inserted to a second apparatus body with the first drum cartridge. The second cover member is guided and held by the second holding portion without blocking of the second cover erroneous insertion blocking portion, if second cover member is inserted into the second apparatus body with the second drum cartridge.

Further features of the present invention will become apparent from the following description of exemplary embodiments with reference to the attached drawings.

DESCRIPTION OF THE EMBODIMENTS

Figure 1:
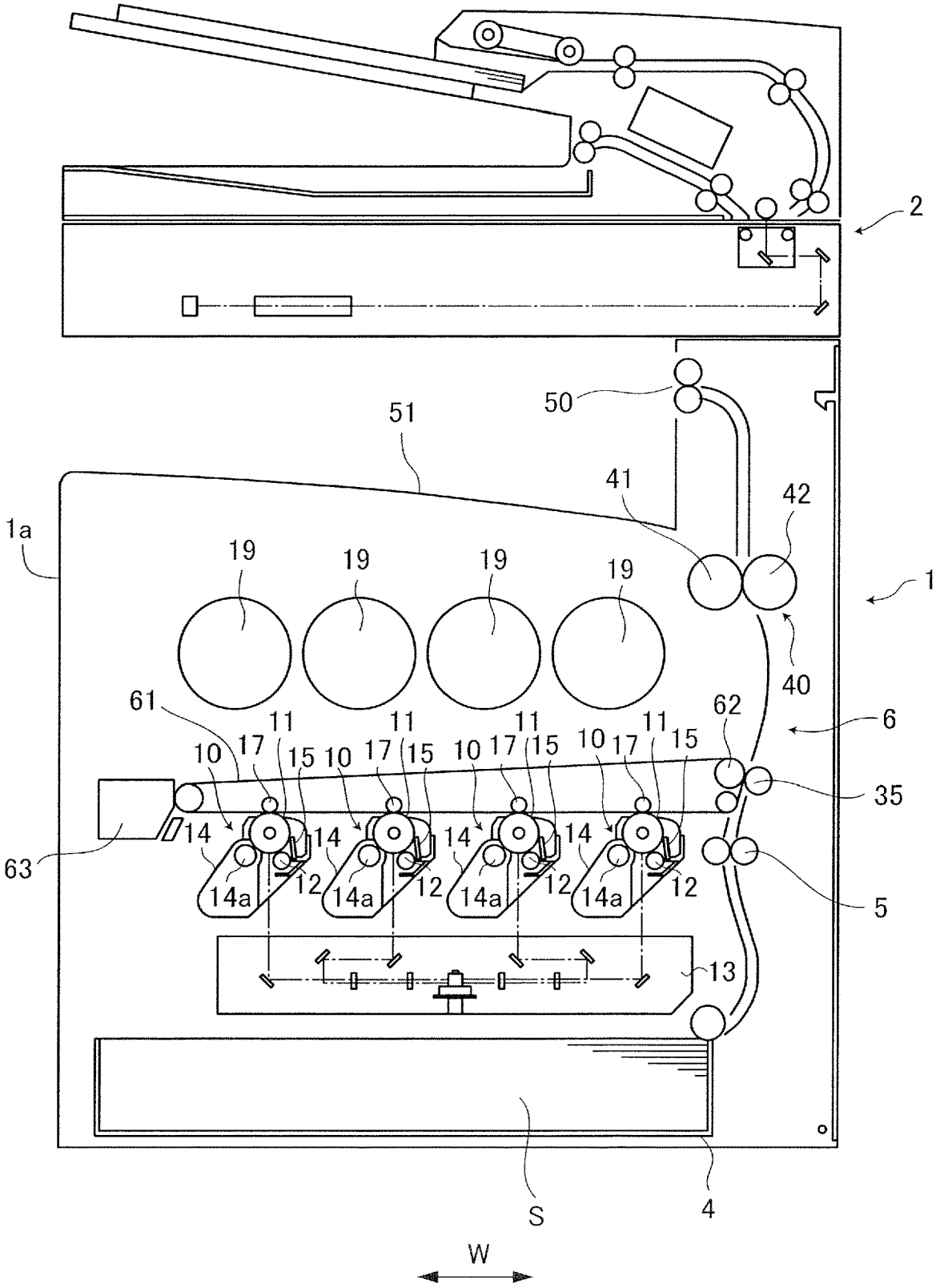
FIG. 1 is a section view illustrating a schematic configuration of an image forming apparatus of embodiment of the present disclosure.

An image forming apparatus 1 of an embodiment of the present disclosure will be described in detail below with reference to FIGS. 1 through 19. It is noted that while a tandem type full-color printer will be described as an exemplary image forming apparatus in the present embodiment, the image forming apparatus of the present disclosure is not limited to be the tandem type image forming apparatus and may be another type image forming apparatus. The image forming apparatus is not also limited to be the full-color printer and may be a monochrome or mono-color printer. Or, the present disclosure may be carried out in various uses such as a printer, various printing machines, a copier, a facsimile machine, a multi-function printer and the like by adding a necessary device, equipment and or a casing structure.

The image forming apparatus 1 of the present embodiment includes an intermediate transfer belt 61 and adopts a secondary transfer system of primarily transferring toner images of respective colors from a photosensitive drum 11 to the intermediate transfer belt 61 and of then secondarily transferring a composite toner images of the respectively colors collectively onto a sheet S. However, the present disclosure is not limited to such system and may adopt a system of directly transferring a toner image from a photosensitive drum onto a sheet conveyed by a sheet conveyance belt. Two-component developer which is a mixture of non-magnetic toner and magnetic carrier is used as developer in the present embodiment. The sheet S serving as a recording material is what the toner image is formed thereon and is specifically a plain sheet of paper, a resin sheet as a substitute of the sheet of paper, a thick sheet, an overhead projector sheet or the like.

Image Forming Apparatus

The image forming apparatus 1 includes image forming portions 10 of each color of Y (yellow), M (magenta), C (cyan) and K (black). The image forming apparatus 1 of the present embodiment is of a so-called tandem type configuration in which the image forming portions 10 of the respective colors are arrayed in a rotation direction of the intermediate transfer belt 61. The image forming portion 10 of each color performs an image forming process as follows. After a surface of the photosensitive drum 11 serving as an image bearing member is homogenously charged by the charging roller 12, a latent image is formed on the surface by a laser scanner 13 driven based on a signal of transmitted image information. It is noted that the image forming apparatus 1 of the present embodiment includes an image reading unit 2, and the image information described above includes image information of a document read by the image reading unit 2 and image information sent from an external terminal such as a personal computer connected with the image forming apparatus 1.

The latent image formed on the photosensitive drum 11 as described above is visualized as a toner image by a developing apparatus 14, and the toner image corresponding to each color is formed on the photosensitive drum 11. That is, the developing apparatus 14 includes a developer sleeve 14*a* serving as a developer bearing member at a position facing the photosensitive drum 11. The developer sleeve 14*a* rotates while bearing the developer within the developing apparatus 14 and supplies toner to the photosensitive drum 11 by a predetermined developing bias applied between the developer sleeve 14*a* and the photosensitive drum 11 to develop the latent image by the toner.

Toner images formed respectively on the photosensitive drums 11 of the respective colors are transferred sequentially onto the intermediate transfer belt 61 by a predetermined pressure and an electrostatic load bias applied by a primary transfer roller 17. After the transfer, residual toner slightly left on the photosensitive drum 11 is removed and collected by a cleaning blade 15 to be ready for a next image forming operation. Because the toner within the developing apparatus 14 is consumed by thus forming the image, toner is replenished from a toner cartridge 19 to the developing apparatus 14.

Meanwhile, the sheet S is fed one by one from a sheet feed cassette 4 and is conveyed to a registration roller pair 5. A skew of the sheet S is corrected by forming a loop such that a front edge follows a nip portion of the registration roller pair 5. After that, the registration roller pair 5 conveys the sheet S between the intermediate transfer belt 61 and a secondary transfer outer roller 35 by synchronizing with the toner image on the intermediate transfer belt 61. The toner image on the intermediate transfer belt 61 is transferred onto the sheet S by a predetermined pressure and an electrostatic load bias applied at the nip portion between a driving roller 62 and the secondary transfer outer roller 35 disposed opposite to each other. After the transfer, slight residual toner left on the intermediate transfer belt 61 is removed and collected by a cleaning unit 63 to be ready for a next image forming operation.

The toner image that has been transferred onto the sheet S is fixed by heat and pressure applied by a heating roller 41 and a pressure roller 42 of a fixing unit 40. The sheet S onto which the toner image has been transferred is conveyed by the recording material conveyance portion 6 and is discharged onto a discharge tray 51 by a discharge roller pair 50. The image forming apparatus 1 of the present embodiment has a so-called in-trunk delivery configuration in which the discharge tray 51 is provided between the apparatus body 1*a*, in which the image forming portion 10, the intermediate transfer belt 61, the fixing unit 40 and others are disposed, and the image reading unit 2.

While an apparatus body 1*a* of the present embodiment is provided with the drum cartridges of yellow, magenta, cyan and black and developing apparatuses as described below and functions as a color image forming apparatus, the embodiment is not limited to such configuration. For instance, the apparatus body 1*a* of the embodiment may be provided with the black drum cartridge and the developing apparatus without the drum cartridges and the developing apparatuses of yellow, magenta and cyan to use as a monochrome image forming apparatus.

Drum Cartridge

Figure 2A:
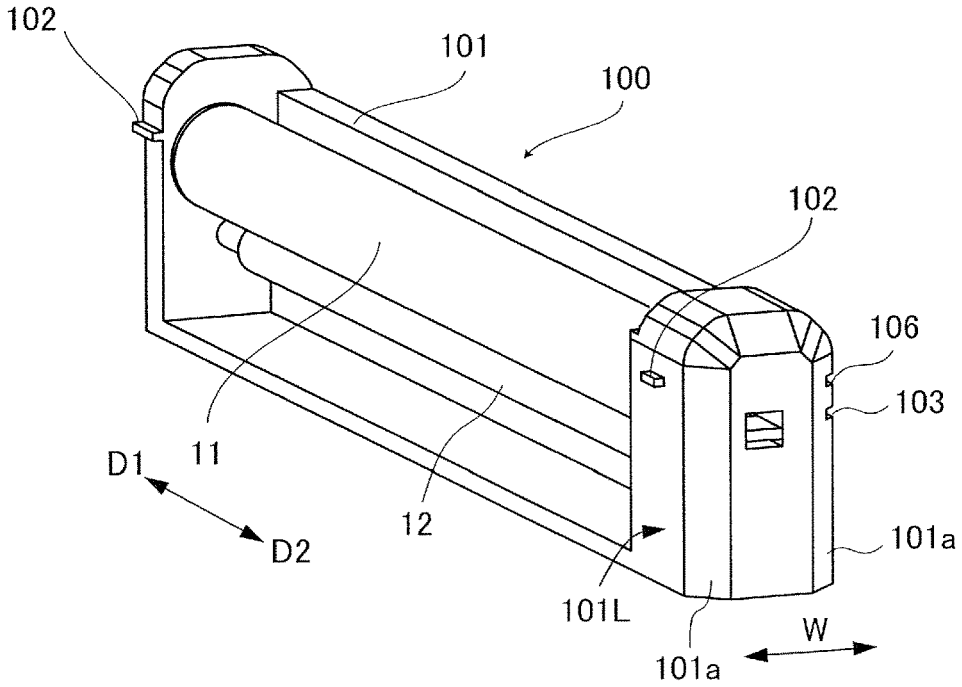
FIG. 2A is a perspective view illustrating a drum cartridge of the embodiment.
Figure 2B:
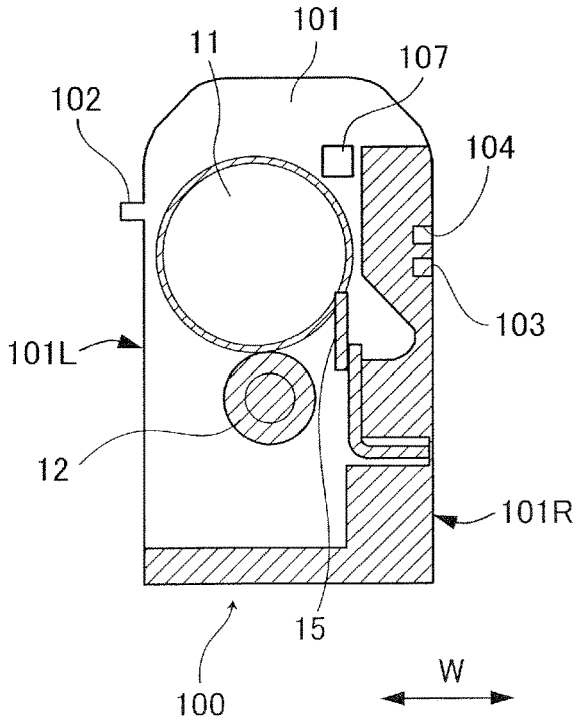
FIG. 2B is a section view of the drum cartridge of the embodiment.

In a case of the present embodiment, a first drum cartridge (referred to simply as a 'cartridge') 100 storing the photosensitive drum 11 serving also as an image forming member for forming an image is configured to be replaceable by enabling to be removably mounted to the apparatus body, i.e., a first apparatus body, 1*a*. As illustrated in FIGS. 2A and 2B, the cartridge 100 includes the photosensitive drum 11, the charging roller 12 and the cleaning blade 15 which are supported integrally by a housing 101. The photosensitive drum 11 and the charging roller 12 are supported to be rotatable with respect to the housing 101 and the charging roller 12 and the cleaning blade 15 are supported while being pressed against the photosensitive drum 11. Here, the cartridge 100 is functionally compatible with the apparatus body 1*a*. That is, the photosensitive drum 11, the charging roller 12, the cleaning blade 15 and other of the cartridge 100 are what function appropriately by being mounted and used in the apparatus body 1*a* and can form an image.

The cartridge 100 illustrated in FIG. 2B includes a light guide 107. The light guide 107 is a lengthy member provided along a longitudinal direction of the photosensitive drum 11. The light guide 107 is supported by the housing 101. The light guide 107 has a function of transmitting light incident on a longitudinal edge in the longitudinal direction. The image forming apparatus 1 includes a luminous body, e.g., LED, not illustrated, and light incident from the luminous body to the light guide 107 exposes the surface of the photosensitive drum 11 at each position in the longitudinal direction of the photosensitive drum 11. The image forming apparatus 1 of the present embodiment is configured to be able to execute a destaticization control for destaticizing the photosensitive drum 11 in the image forming process. The destaticization control is an exposure control for discharging and eliminating electric charge left on the photosensitive layer of the photosensitive drum 11 in the image forming process. Charge carrier is generated in an entire area of a charge generating layer of the photosensitive member, and residual charge left on the charge generating layer is discharged by executing the destaticization control. Ununiformity of electric potential of the photosensitive drum 11 is eliminated by discharging the residual charge. It is noted that in a case when the apparatus body 1*a* is used as a monochrome image forming apparatus, no light guide body 107 needs to be provided in the cartridge for the monochrome image forming apparatus because the destaticization control is not essential. That is, no light guide 107 needs to be always provided in the cartridge to be mounted to the monochrome image forming apparatus in a case where the charge (drum memory) left on the photosensitive layer of the photosensitive drum 11 is caused by the toners of yellow, magenta and cyan transferred onto the intermediate transfer belt 61 upstream of the primary transfer portion of black in the rotation direction of the intermediate transfer belt 61.

Because the photosensitive drum 11, the charging roller 12 and the cleaning blade 15 deteriorate in response to an increase of number of images thus formed, the cartridge 100 needs to be replaced corresponding to an amount of prints. Accordingly, the cartridge 100 is configured to be able to be inserted in a front-rear direction, i.e., to a rear side of the apparatus body 1*a*, and to be able to be pulled out toward the front side such that the cartridge 100 can be replaced in a case where a service life thereof ends. It is noted that the front side of the apparatus body 1*a* is a side where a user can manipulate the image forming apparatus 1.

Figure 3:
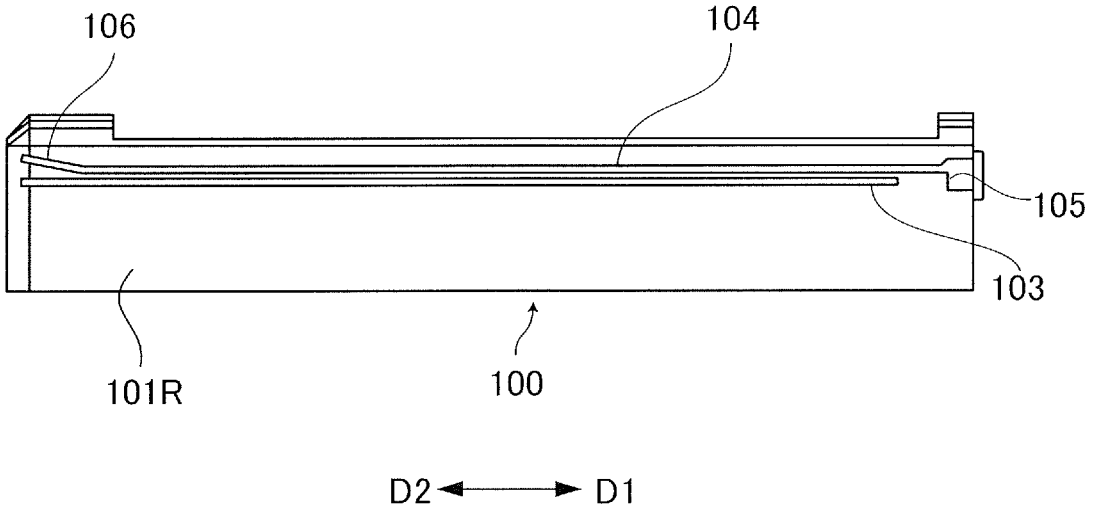
FIG. 3 is a side view of the drum cartridge of the embodiment.

Here, an insert direction is defined as a direction in which the cartridge 100 is inserted into the apparatus body 1*a*, i.e., an insert direction D1 indicated by an arrow in FIGS. 2A and 3. Still further, the pull-out direction is defined as a direction in which the cartridge 100 is pulled out of the apparatus body 1*a*, i.e., a pull-out direction D2 in an opposite direction of the insert direction D1 indicated by an arrow in FIGS. 2A and 3. That is, the cartridge 100 can be inserted into the apparatus body 1*a* in the insert direction D1 and can be pulled out of the apparatus body 1*a* in the pull-out direction D2. It is noted that a direction horizontally orthogonal to the insert direction D1 and the pull-out direction D2 will be defined as a width direction W.

By mounting the cartridge 100 into the apparatus body 1*a*, the photosensitive drum 11 is coupled with and driven by a drive transmission portion of a motor, which is a driving source not illustrated on the apparatus body 1*a* side, through a first coupling. Thereby, the photosensitive drum 11 is rotationally driven by the motor. Because the charging roller 12 is pressed against the photosensitive drum 11, the charging roller 12 rotates following the photosensitive drum 11. That is, in a case where the cartridge 100 is mounted to the apparatus body 1*a*, the first coupling couples the first driving source provided in the apparatus body 1*a* with the photosensitive drum 11 of the cartridge 100.

As illustrated in FIGS. 2A, 2B and 3, the housing 101 of the cartridge 100 is provided with a rib 102 and a guide 103 which are to be guided by a cover member 200 in inserting the cartridge 100 into the apparatus body 1*a*. As illustrated in FIGS. 2A and 2B, the ribs 102 are formed on one side surface 101L (left side surface in FIG. 2B) so as to protrude to the side at respective parts in the insert direction D1 and the pull-out direction D2 of the cartridge 100. As illustrated in FIGS. 2B and 3, the guide 103 is a groove defined on another side surface 101R (right side surface in FIG. 2B) of the housing 101 approximately in parallel with the insert direction D1.

Figure 6:
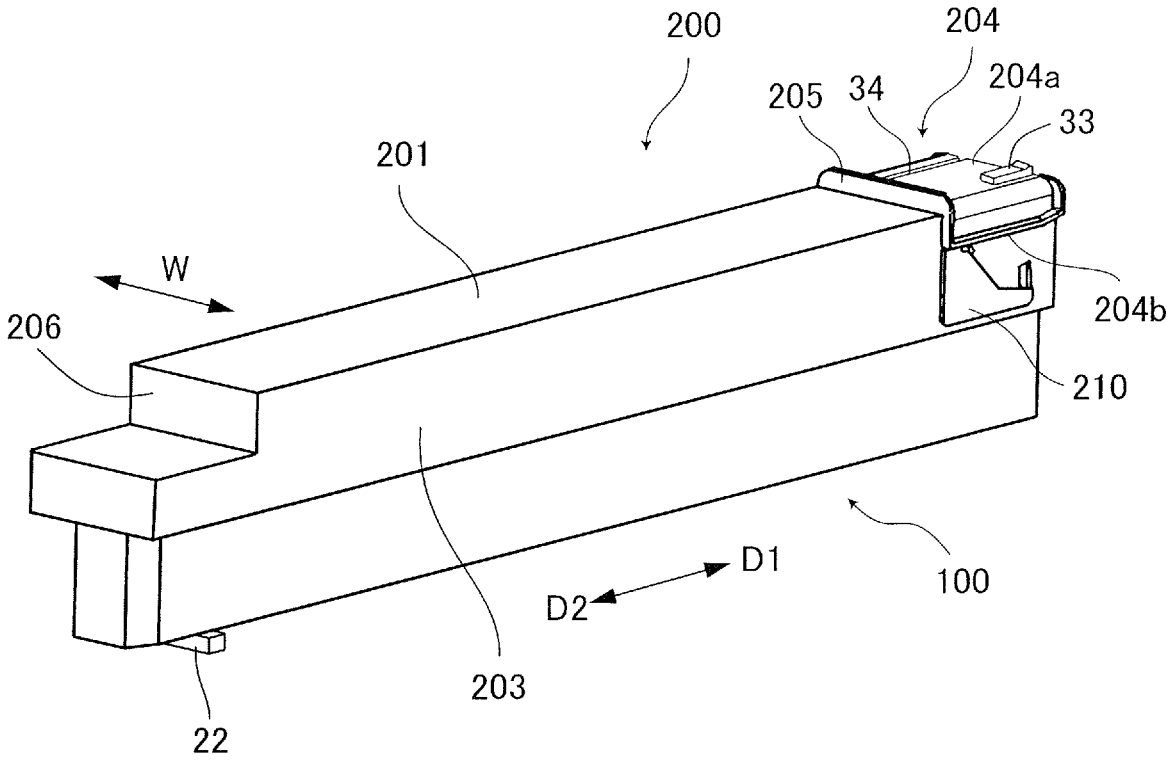
FIG. 6 is a perspective view illustrating a condition in which the cover member is attached to the drum cartridge of the present embodiment.

The cover member 200 for shading the photosensitive drum 11 is removably attached to the cartridge 100 before the cartridge 100 is mounted to the apparatus body 1*a* (see FIG. 6). A groove-like lock guide portion 104 is defined adjacent the guide 103 along the insert direction D1 on the other side surface 101R of the housing 101. The lock guide portion 104 is defined engageably with a protrusion 211 formed on a swing plate 210 (see FIG. 14B and others) provided on the cover member 200 so as to engage and guide the protrusion 211. As illustrated in FIG. 3, defined at a front end portion in the insert direction D1 of the lock guide portion 104 (right end in FIG. 3) is a lock portion 105 whose width in a vertical direction is wider than a width of the lock guide portion 104 and which is provided with a level difference from the lock guide portion 104. Defined also at a front end portion in the pull-out direction D2 of the lock guide portion 104 (left end in FIG. 3) is a groove-like guide portion 106 inclined upward from the lock guide portion 104. The unlock guide portion 106, the lock guide portion 104 and the lock portion 105 are formed sequentially and continuously along the insert direction D1 and position a rotational phase of the swing plate 210 at each predetermined position by engaging with the protrusion 211 (see FIGS. 14A through 16B).

Figure 18A:
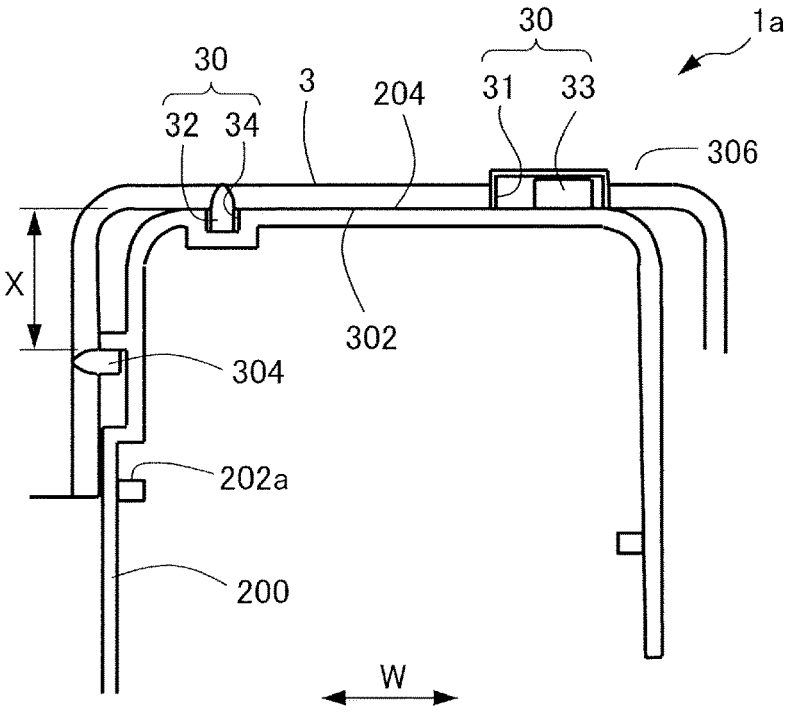
FIG. 18A is a section view illustrating an engagement portion of the cover member side engaging with the drum cartridge compatible with the apparatus body of the present embodiment.
Figure 18B:
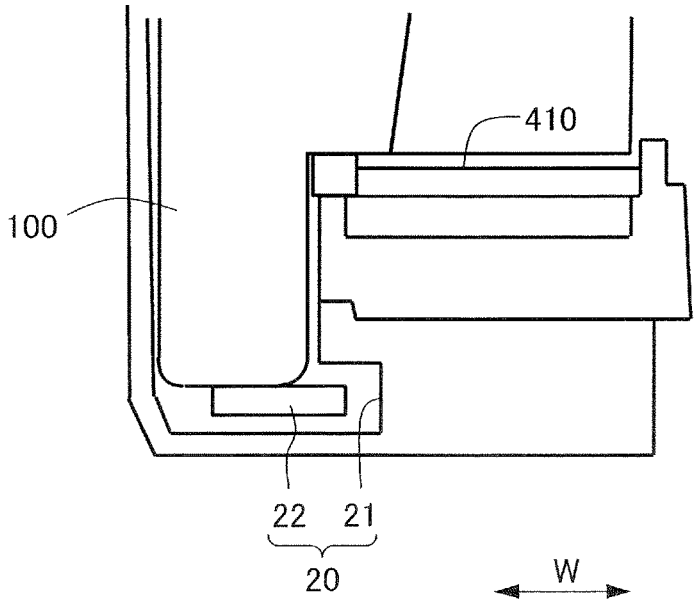
FIG. 18B is a section view illustrating the engagement portion of the drum cartridge side.

The housing 101 of the cartridge 100 is provided with a second project portion 22 formed at the front end portion in the insert direction D1 (see FIG. 18B). The second project portion 22 composes a first cartridge erroneous insertion blocking portion 20 (see FIG. 18B). A detailed configuration of the first cartridge erroneous insertion blocking portion 20 will be described later.

Cover Member

Figure 4A:
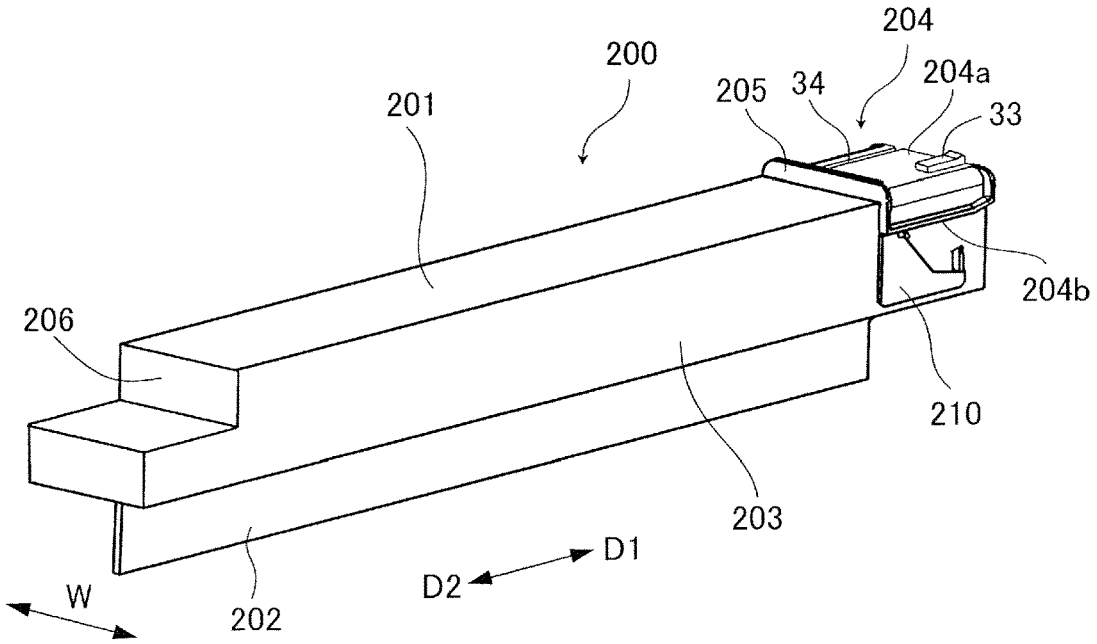
FIG. 4A is a perspective view of a cover member of the embodiment viewed from a side.

Before the cartridge 100 is mounted to the apparatus body 1*a*, the first cover member 200 (referred to simply as a 'cover member' hereinafter) for at least covering the photosensitive drum 11 is attached to the cartridge 100 to shade and protect members such as the photosensitive drum 11. As illustrated in FIG. 4A, the cover member 200 is formed approximately into a shape of a box which is long in the insert direction D1 of the cartridge 100 and whose front end side and a lower side in the insert direction D1 are opened. It is noted that while the insert direction D1 and the pull-out direction D2 are used as indicators of the directions also for the cover member 200 similarly to the cartridge 100 in the following description, these are directions in a condition in which the cover member 200 is attached to the cartridge 100.

As illustrated in FIGS. 4A through 5A, the cover member 200 includes a top plate portion 201, a first side plate 202 and a second side plate 203. The top plate portion 201, the first side plate 202 and the second side plate 203 function as a cover portion covering a photosensitive surface of the photosensitive drum before the cartridge 100 is mounted to the apparatus body 1*a*. The first and second side plates 202 and 203 are provided so as to project downward respectively from both widthwise ends of the top plate portion 201. In the present embodiment, a length in the vertical direction of the first side plate 202 is longer than that of the second side plate 203. This arrangement makes it possible for the first side plate 202 facing the developing apparatus 14 to adequately cover a side exposing in a wide range of the photosensitive drum 11.

Figure 4B:
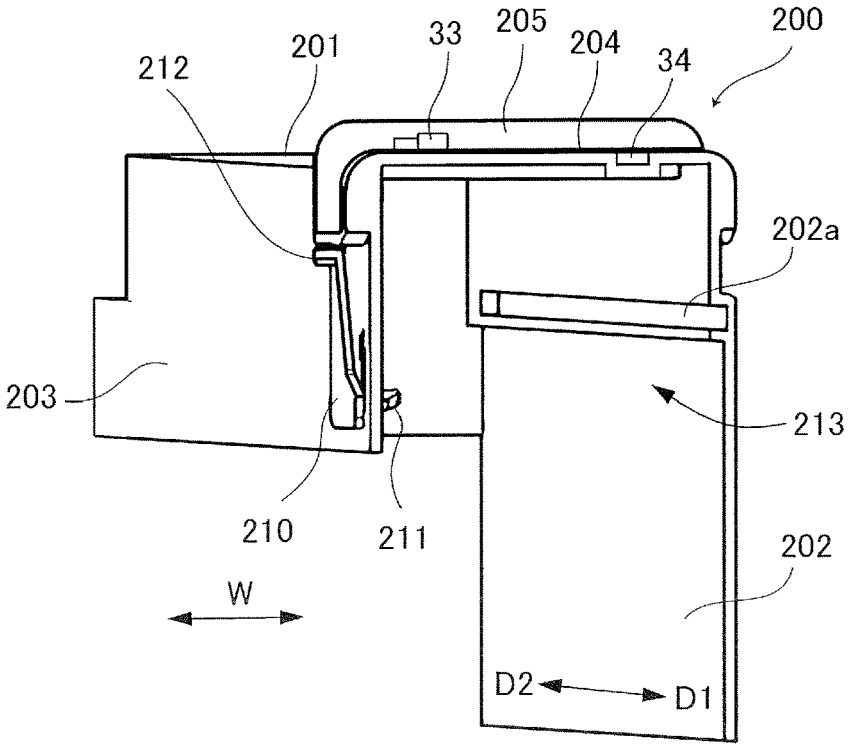
FIG. 4B is a perspective view of the cover member of the embodiment viewed from a front end side of an insert direction.
Figure 5A:
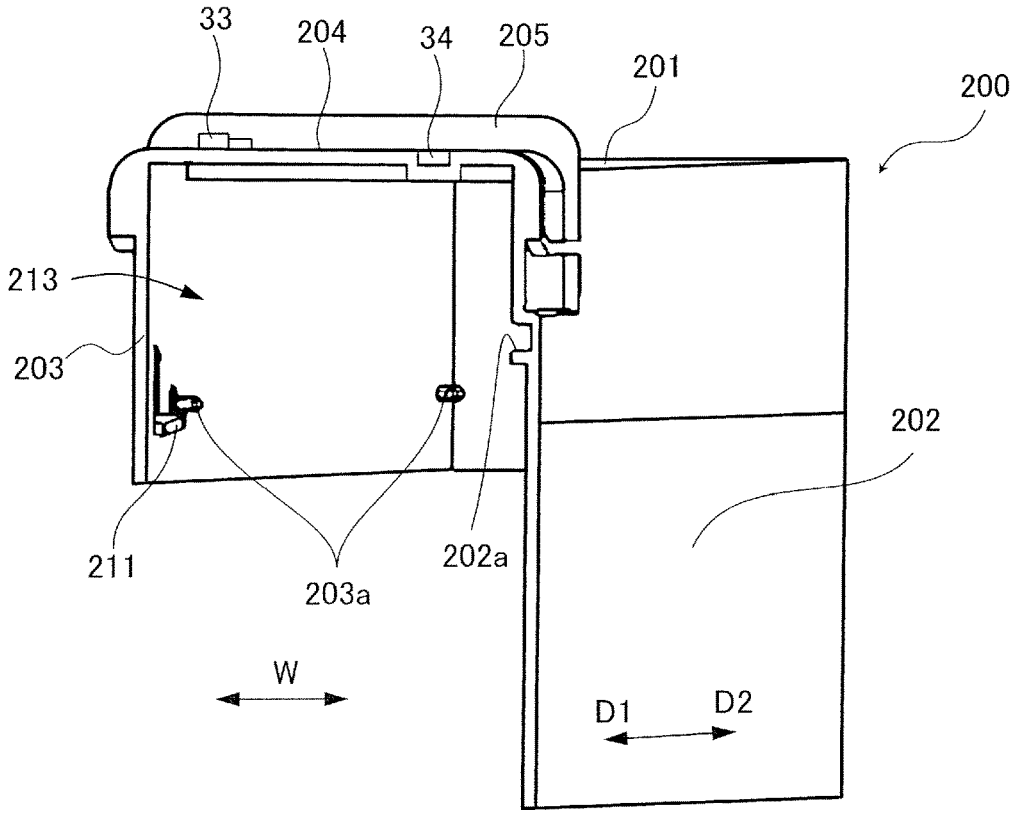
FIG. 5A is a perspective view of the cover member of the embodiment viewed from the front end side of the insert direction in an angle direction different from that of FIG. 4B.
Figure 5B:
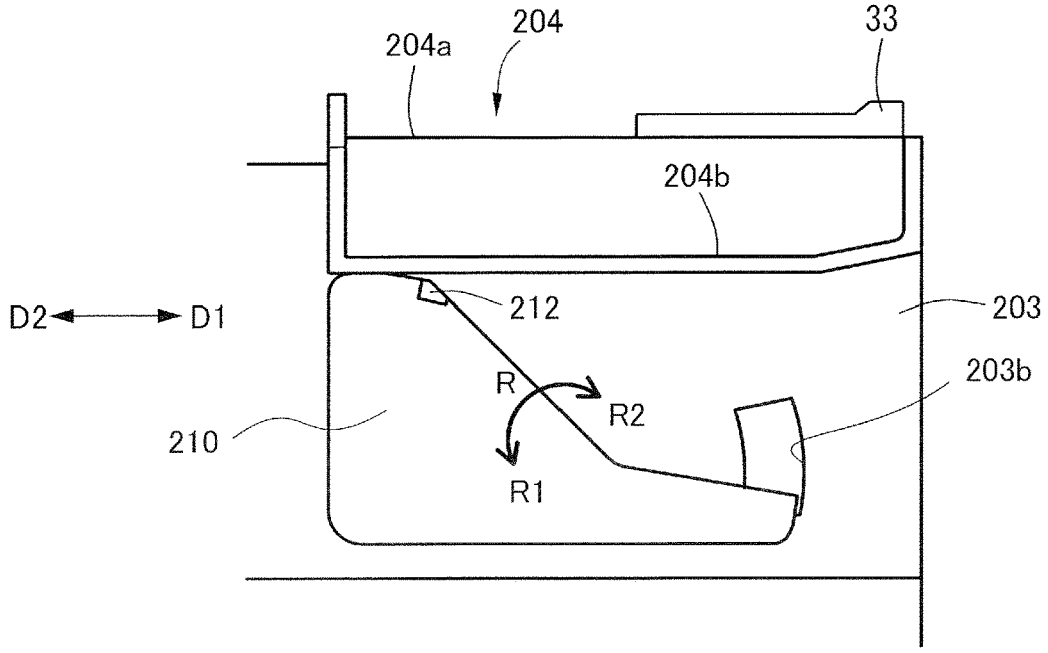
FIG. 5B is a side view illustrating the cover member of the embodiment by enlarging a part of the front end side of the insert direction.

As illustrated in FIG. 4B, the first side plate 202 is provided with a groove-like drum guide 202*a* defined on an inner side surface thereof along the insert direction D1. As illustrated in FIG. 5A, the second side plate 203 is provided with holding ribs 203*a* so as to project respectively at parts leaning both ends in the insert direction D1 of the inner side surface thereof.

Provided at the front end portion in the insert direction D1 of the cover member 200 is an insert portion 204 to be inserted into a predetermined position of the apparatus body 1*a*. The insert portion 204 includes an abutment surface 204*a* facing upward and an engage rib 204*b*. Provided at the pull-out direction D2 side of the insert portion 204 is a contact portion 205 that butts against a part of the apparatus body 1*a* in inserting into the apparatus body 1*a*. Provided at the front end side in the insert direction D1 of the cover member 200 is an opening 213 through which the cartridge 100 can be inserted/pulled out as illustrated in FIGS. 4B and 5A. As illustrated in FIG. 4A, the pull-out direction D2 side of the cover member 200 is covered by a rear side plate 206 so as to connect rear end portions of the second side plate 203 and the first side plate 202.

A cover-side project portion 33 and a cover-side channel portion 34, serving as a second portion, are provided in parallel in the width direction W on the abutment surface 204*a* of the insert portion 204. The cover-side project portion 33 composes a cover erroneous insertion blocking portion 30 serving as a first cover erroneous insertion blocking portion (see FIG. 18A). The cover-side channel portion 34 also composes the cover erroneous insertion blocking portion 30 (see FIG. 18A). That is, the cover-side project portion 33 and the cover-side channel portion 34 are provided outside of the cover member 200 attached to the cartridge 100. A detailed configuration of the cover erroneous insertion blocking portion 30 will be described later.

As illustrated also in FIGS. 4A through 5B, the swing plate 210 serving as a moving unit is disposed widthwise outside of the second side plate 203 at the front end side in the insert direction D1 of the second side plate 203. The swing plate 210 is provided swingably (movably) in a swing direction R in FIG. 5B with respect to the second side plate 203 centering on a swing shaft not illustrated and whose axial direction orients in the width direction W. It is noted that in FIG. 5B, a left-turn direction of the swing plate 210 is an unlock direction R1 and a right-turn direction is a lock direction R2. The swing plate 210 includes a front end portion and a base end portion. The front end portion in the insert direction D1 is formed such that a width in the vertical direction thereof is small, and the base end portion is formed such that a width in the vertical direction on the pull-out direction D2 side is large.

Figure 14A:
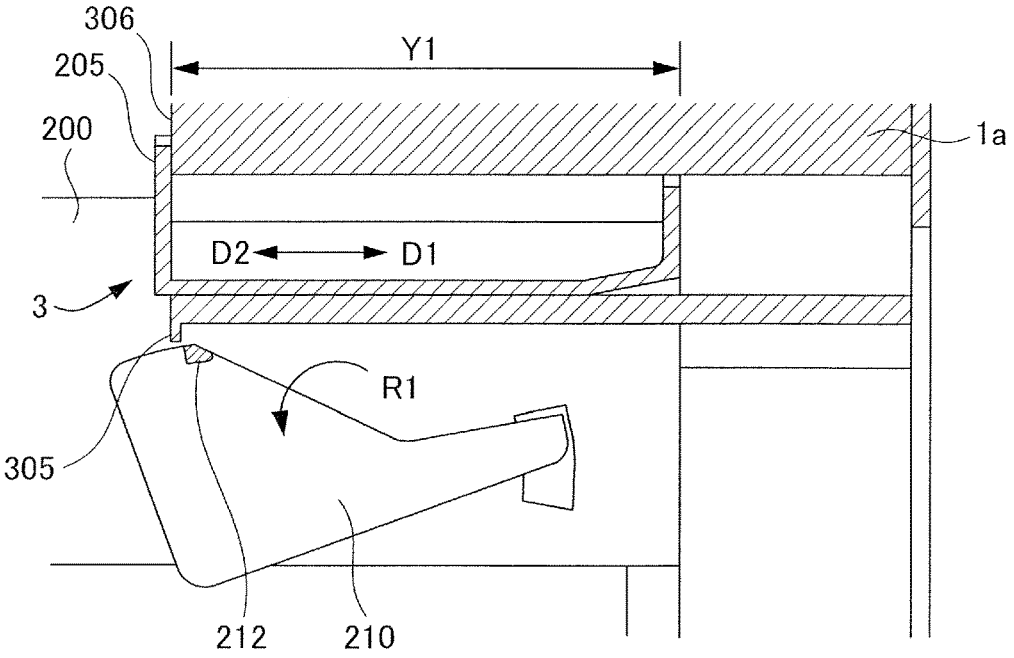
FIG. 14A is a section view illustrating the relationship between the engage portion of the swing plate and the projecting portion of the apparatus body in a condition of a third step of mounting the drum cartridge of the present embodiment to the apparatus body.
Figure 14B:
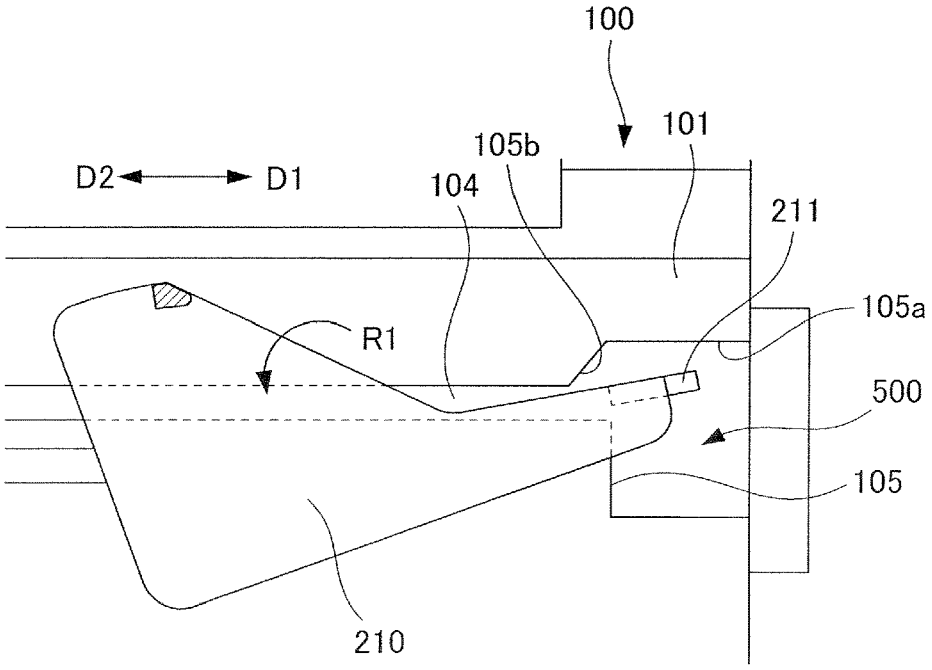
FIG. 14B is a side view illustrating a relationship between the protrusion of the swing plate and the lock portion of the apparatus body.

Provided at the front end portion of the swing plate 210 is the protrusion 211 protruding toward the inside of the cover member 200, i.e., toward the cartridge 100 covered by the cover member 200 (see FIG. 14B). The second side plate 203 is provided with a through hole 203*b* along the swing direction R of the swing plate 210 in an area corresponding to the front end portion in the insert direction D1 of the swing plate 210. Then, as illustrated in FIGS. 4B and 5A, the protrusion 211 formed at the front end portion of the swing plate 210 protrudes inside of the cover member 200 (see FIGS. 14A and 14B) through the through hole 203*b*. This arrangement makes it possible for the swing plate 210 to swing within a range in which the protrusion 211 is movable within the through hole 203*b*. As illustrated also in FIG. 5B, the swing plate 210 is provided with an engagement portion 212 projecting to a side opposite from the second side plate 203, i.e., to outside in the width direction W, at an upper end portion leaning the front end in the pull-out direction D2 thereof. That is, the cover member 200 shading the photosensitive drum 11 is removably attached to the cartridge 100 before being mounted to the apparatus body 1*a*, and the cartridge 100 is functionally compatible with the apparatus body 1*a*.

Attaching Cover Member to Drum Cartridge

Figure 7A:
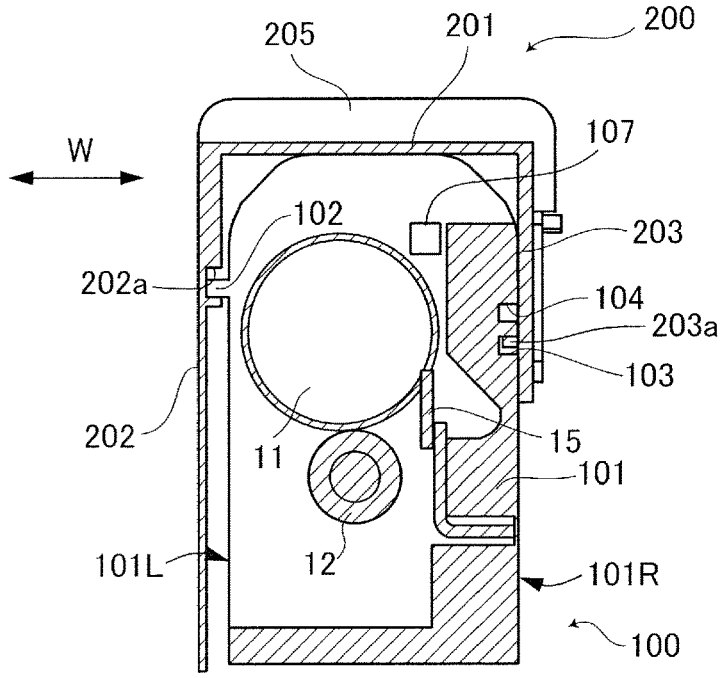
FIG. 7A is a section view illustrating the condition in which the cover member is attached to the drum cartridge of the present embodiment.
Figure 7B:
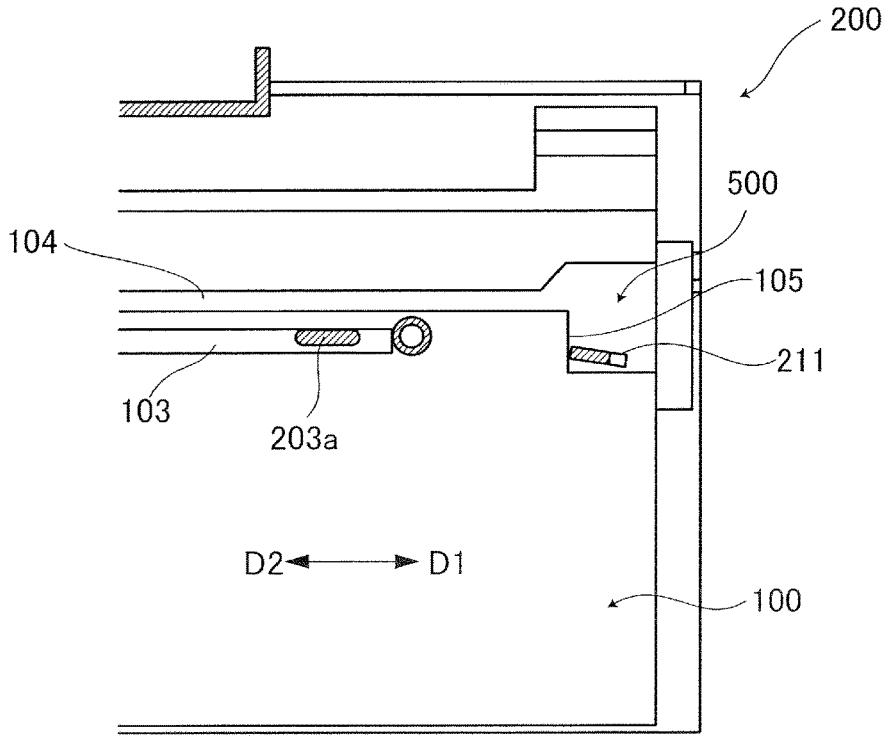
FIG. 7B is a longitudinal section view illustrating a condition in which the cover member is locked to the drum cartridge of the embodiment.

As illustrated in FIGS. 6 through 7B, the cover member 200 is attached to the cartridge 100 before the cartridge 100 is mounted to the apparatus body 1*a*. The cartridge 100 is inserted from the opening 213 (see FIG. 4B) on the front end side in the insert direction D1 of the cover member 200. At this time, the rib 102 formed on one side surface 101L of the housing 101 of the cartridge 100 engages with a drum guide 202*a* formed on an inner surface of the first side plate 202 of the cover member 200 as illustrated in FIG. 7A. The guide 103 formed on the other side surface 101R of the housing 101 is also engaged with the holding rib 203*a* formed on the inner surface of the second side plate 203.

By engaging these guides serving as guide portions with the ribs, respectively, the cartridge 100 is guided within the cover member 200 along the pull-out direction D2. In the condition in which the cover member 200 is thus attached to the cartridge 100, a space in which the photosensitive drum 11 and others are disposed is covered by the top plate portion 201, the first side plate 202 and the second side plate 203 such that the photosensitive drum 11 and others are shaded so as not to be exposed outside.

As illustrated in FIG. 7B, in the attachment condition of the cartridge 100 and the cover member 200, the protrusion 211 of the swing plate 210 of the cover member 200 engages with the lock portion 105 formed on the housing 101 of the cartridge 100. Therefore, the cartridge 100 and the cover member 200 are locked so as not to be separated as it is in the attachment condition, and the cartridge 100 is prevented so as not to be pulled out of the opening 213 on the front end side in the insert direction D1 of the cover member 200. That is, the cartridge 100 becomes relatively immovable in the insert direction D1 with respect to the cover member 200. It is noted that because the front end side in the pull-out direction D2 of the cover member 200 is covered by the rear side plate 206, the cartridge 100 will not be pulled out from the pull-out direction D2.

Replacing Drum Cartridge

Next, a replacing operation of the cartridge 100 of the present embodiment in the apparatus body 1*a* will be described. At first, an operation of pulling out the cartridge 100 attached to the apparatus body 1*a* will be described with reference to FIGS. 8A through 10.

Pulling Out Drum Cartridge

Figure 8A:
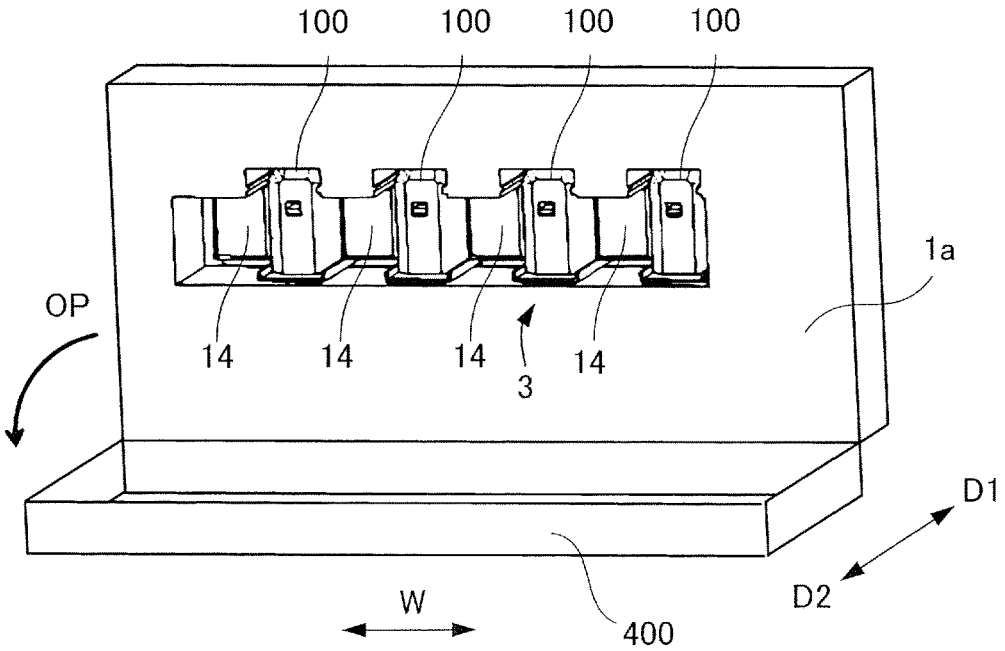
FIG. 8A is a perspective view illustrating a part of an apparatus body of the present embodiment in a condition in which a front cover is opened.
Figure 8B:
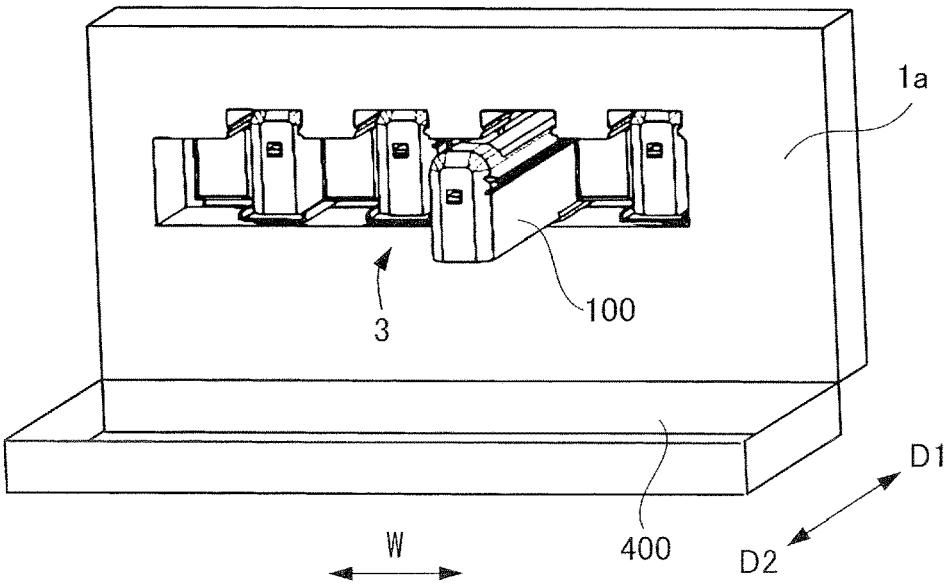
FIG. 8B is a perspective view illustrating a part of an apparatus body of the present embodiment in a condition in which the drum cartridge is taken out of the apparatus body.

FIGS. 8A and 8B are schematic diagrams simply excerpting and illustrating a configuration of a part of the image forming apparatus 1 of the present embodiment into which the cartridge 100 of each color is attached. The apparatus body 1*a* is provided with a front cover 400 openable on a front side, and it is possible to access to the cartridge 100 of each color by opening the front cover 400 in a direction OP as illustrated in FIG. 8A. The apparatus body 1*a* includes the plurality of cartridges 100 arrayed in order of yellow, magenta, cyan and black from the left side in FIG. 8A. The plurality of cartridges 100 has a common configuration from each other in the present embodiment. The cover member 200 configured to cover the cartridge 100 of each color also has a common configuration from each other. It is noted that the developing apparatus 14 of each color is disposed adjacent the cartridge 100 of each color, respectively in FIG. 8A.

While the replacement of the cartridge 100 of cyan (third one from the left side in FIG. 8A) will be described in the following description, the same applies also to the other color cartridges. Assume that a replacement sign of the cyan cartridge 100 is notified in a display, e.g., a control panel, not illustrated of the image forming apparatus 1 or in an external terminal connected to the image forming apparatus. In this case, an operator such as the user, a service man or the like opens the front cover 400 as illustrated in FIG. 8A. Next, the operator pulls the pertinent cartridge 100 out of the apparatus body 1*a* as illustrated in FIG. 8B.

Figure 9A:
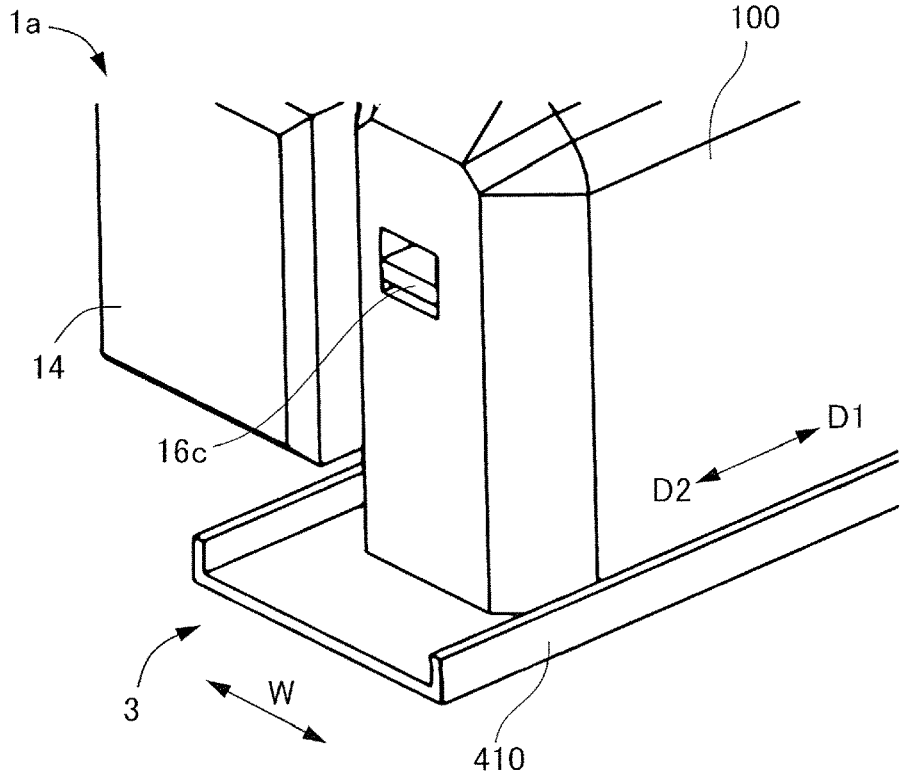
FIG. 9A is a perspective view illustrating a part of the apparatus body of the present embodiment in a condition in which the drum cartridge is installed on a guide rail.
Figure 9B:
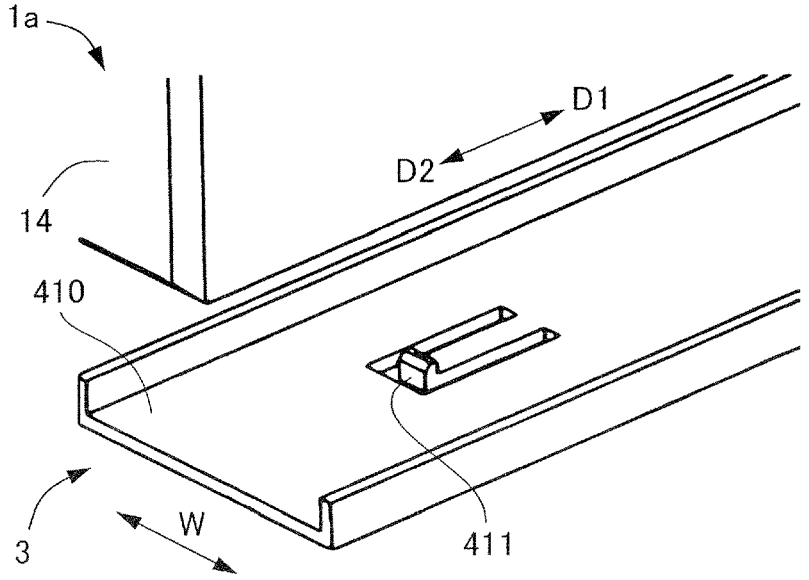
FIG. 9B is a perspective view illustrating a part of an apparatus body of the present embodiment in a condition in which the drum cartridge is taken out of the guide rail.
Figure 10:
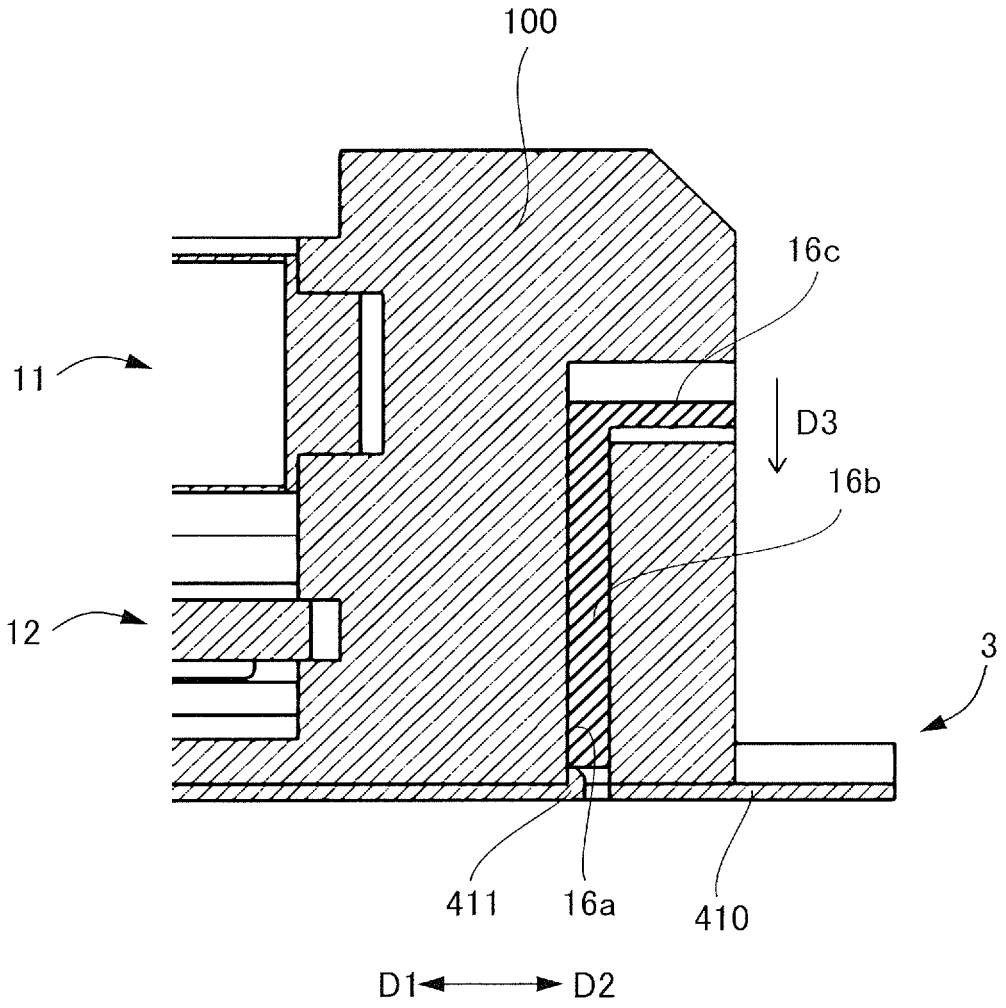
FIG. 10 is a section view illustrating a lock mechanism of the drum cartridge and the guide rail of the present embodiment.

As illustrated in FIGS. 9A through 10, the apparatus body 1*a* is provided with a guide rail, i.e., a first guide portion, 410 configured to guide the cartridge 100. The guide rail 410 is configured to match in shape with the cartridge 100 and to guide the cartridge 100 in a case where the cartridge 100 attached with the cover member 200 is inserted into the apparatus body 1*a* from an insertion slot portion 3 described later of the apparatus body 1*a*.

The guide rail 410 is provided with a locking hook 411 which is supported movably in the vertical direction by elastic deformation thereof and whose edge protrudes upward at a part of the guide rail 410 as illustrated in FIG. 9B. Meanwhile, as illustrated in FIG. 10, the housing 101 of the cartridge 100 (see FIG. 7A) is provided with an engage hole 16*a* at a bottom surface thereof. In a condition in which the cartridge 100 is mounted on the guide rail 410 and is attached at a predetermined attachment position of the apparatus body 1*a*, the locking hook 411 engages with the engage hole 16*a* of the cartridge 100. Thereby, the cartridge 100 is locked so as not to be pulled out from the predetermined attachment position of the apparatus body 1*a*.

As illustrated in FIG. 10, an unlock member 16*b* is disposed within the engage hole 16*a*. The unlock member 16*b* is movable along the engage hole 16*a* formed in the vertical direction and includes a control lever 16*c* that is exposed to the front surface of the cartridge 100 and that can be controlled by the operator. If the operator pushes down the control lever 16*c* in a lower direction D3 in FIG. 10, a whole of the lock release member 16*b* is lowered. Then, the locking hook 411 is pressed down by a lower end portion of the unlock member 16*b*, and thus the engagement between the locking hook 411 and the engage hole 16*a* is released. Thereby, the cartridge 100 is unlocked from the guide rail 410, and the operator can pull the cartridge 100 out of the apparatus body 1*a* in the pull-out direction D2.

After pulling the cartridge 100 out of the apparatus body 1*a*, it is unnecessary to handle the cartridge 100 carefully as compared with a new cartridge to be inserted into the apparatus body 1*a*, because the cartridge 100 is no longer used. The service man or the like collects the cartridge 100 being pulled out. It is noted that the cover member 200 may be attached to the insertion slot portion 3 described later of the apparatus body 1*a* (see FIG. 8B) so as to guide the cartridge 100 to the inside of the cover member 200 in pulling out the cartridge 100. This arrangement makes it possible to prevent the operator from being soiled by toner or the like even if the toner or the like is adhering on the photosensitive drum 11 or the like.

Mounting Drum Cartridge

Figure 11A:
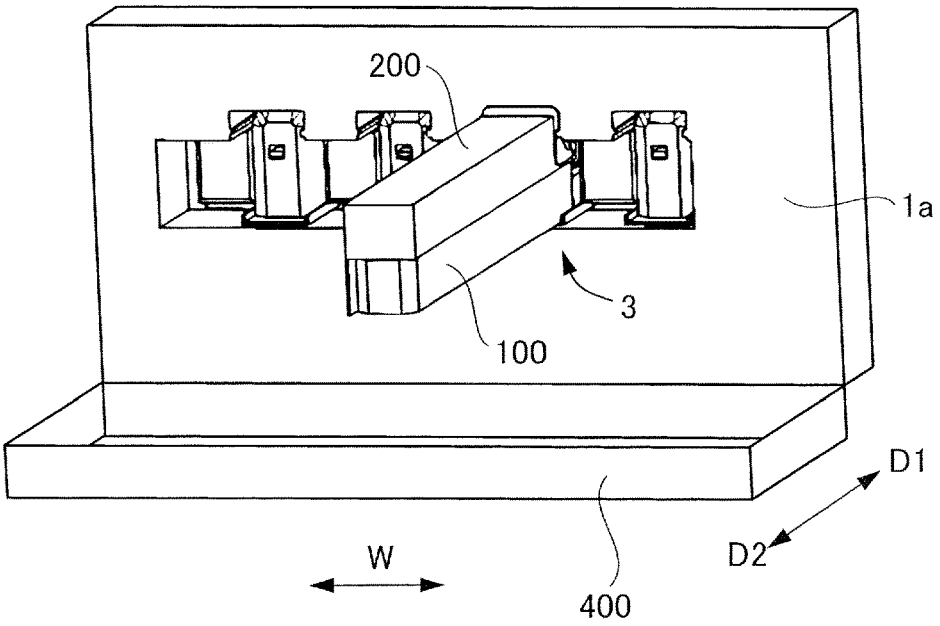
FIG. 11A is a perspective view illustrating a part of the apparatus body of the present embodiment in a condition in which the drum cartridge is set at an insert position through the cover member.
Figure 11B:
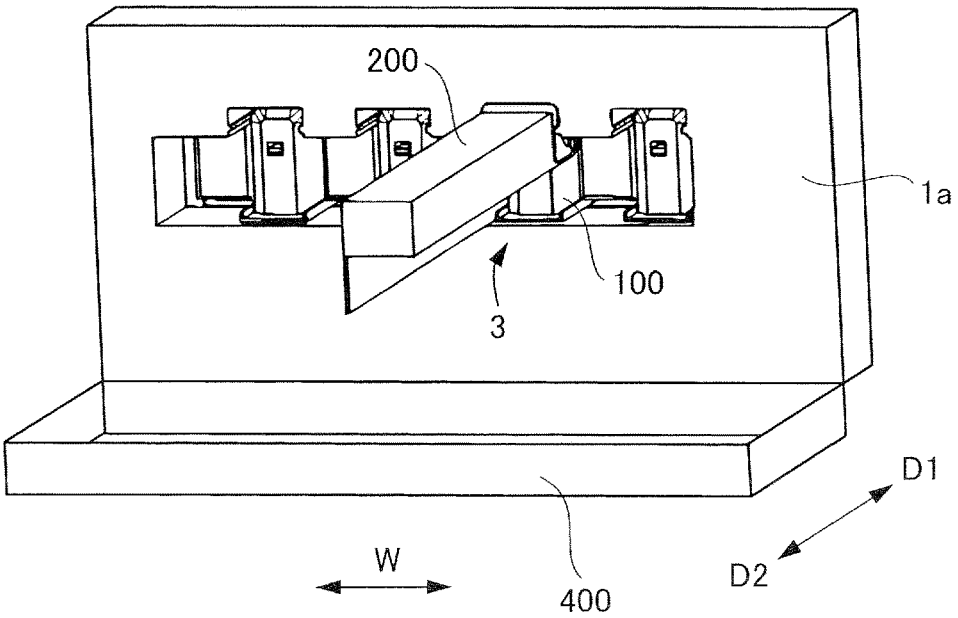
FIG. 11B is a perspective view illustrating a part of an apparatus body of the present embodiment in a condition in which the drum cartridge has been inserted into the apparatus body.

Next, an operation for mounting the cartridge 100 into the apparatus body 1*a* will be described with reference to FIGS. 11A through 12. At first, the operator inserts a new cartridge 100 covered by the cover member 200 into the insertion slot portion 3, i.e., a first insertion slot portion, of the apparatus body 1*a* as illustrated in FIG. 11A. Then, the operator inserts the cartridge 100 into the apparatus body 1*a* by relatively moving the cartridge 100 in the insert direction D1 with respect to the cover member 200 as illustrated in FIG. 11B.

Figure 12:
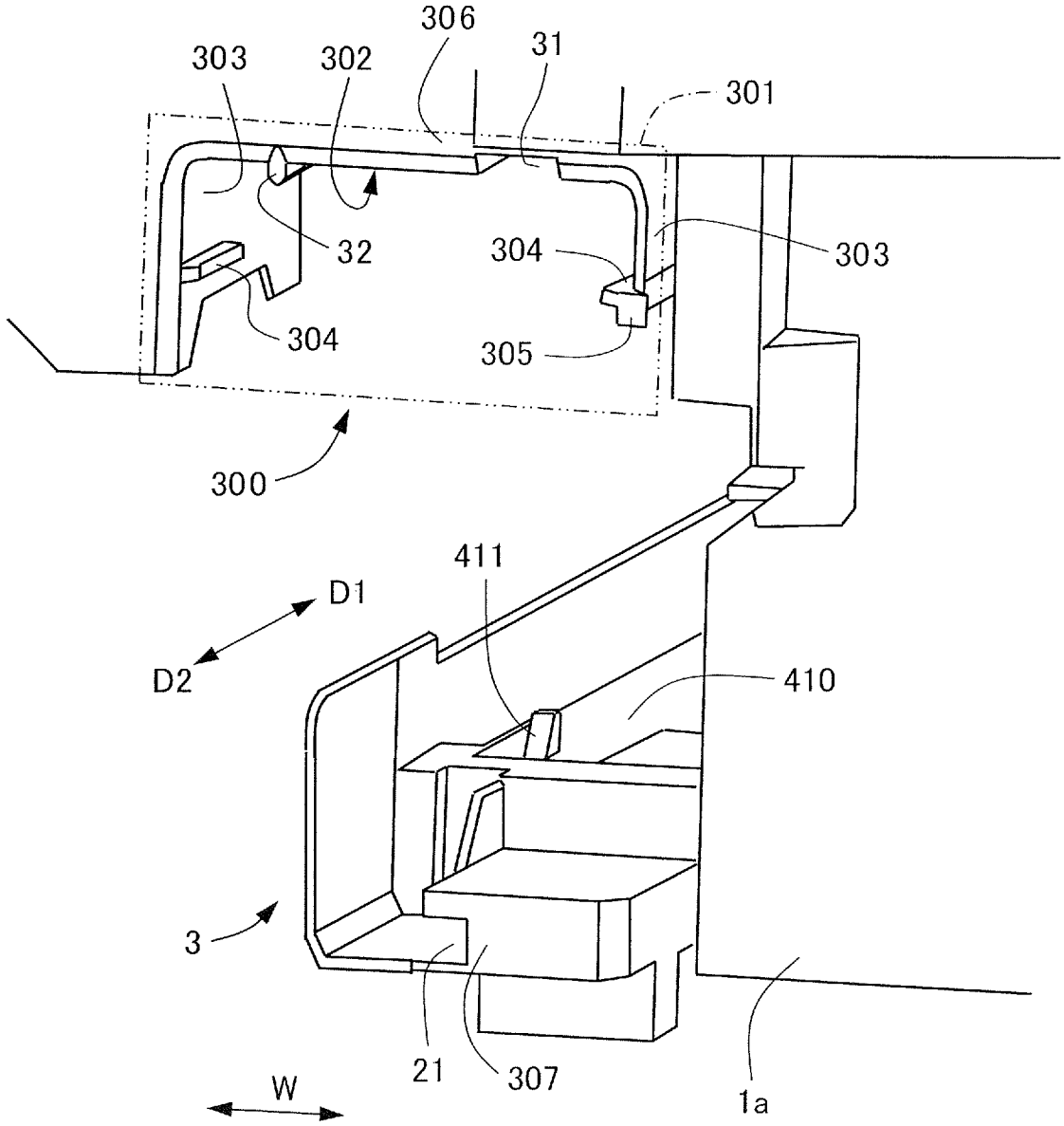
FIG. 12 is a perspective view illustrating a drum cartridge storage portion in the apparatus body of the present embodiment.

Here, as illustrated in FIG. 12, the apparatus body 1*a* includes a storage portion 300 formed toward the insert direction D1 from the insertion slot portion 3 so as to store the cartridge 100 inserted from the insertion slot portion 3. The storage portion 300 includes a supporting portion 301 formed engageably with the insert portion 204 (see FIG. 6) provided at the front end portion in the insert direction D1 of the cover member 200. The supporting portion 301 supports the cover member 200 in the insert direction D1 of the cartridge 100 and a downstream end in the insert direction D1 of the cartridge 100 in a condition in which the cartridge 100 covered by the cover member 200 is inserted by a predetermined distance from the insertion slot portion 3 of the apparatus body 1*a*. If the operator releases his/her hands from the cover member 200 or the cartridge 100 in the condition as illustrated in FIG. 11A, the cover member 200 and the cartridge 100 drop by their own weights. Therefore, a support of the operator of holding a part of the cover member 200 or the cartridge 100 upstream in the insert direction D1 of the insert portion 204 is necessary in the condition illustrated in FIG. 11A.

The supporting portion 301 is formed so as to be concaved upward in the storage portion 300 and so as to have a predetermined length in the insert direction D1. The supporting portion 301 includes a supporting surface 302 provided at an upper surface, side walls 303 provided at both widthwise ends of the supporting surface 302, and guide ribs 304 formed on the side walls 303 along the insert direction D1. The supporting portion 301 is also provided with a projecting portion, i.e., an engaged portion, 305 formed so as to project downward at an end in the pull-out direction D2 of the guide rib 304 of one side (right side in FIG. 12) of the supporting portion 301 (left side in FIG. 13A). End faces on the pull-out direction D2 side of the supporting surface 302 and the side walls 303 are formed to be a contact surface 306 with which the contact portion 205 of the cover member 200 abuts (see FIG. 14A).

The first channel portion 31 and the body-side project portion 32, serving as the second portion, are provided in parallel in the width direction W on the pull-out direction D2 side of the support surface 302. The first channel portion 31 and the body-side project portion 32 are exposed to the contact surface 306 in the present embodiment. That is, the first channel portion 31 and the body-side project portion 32 are disposed at the front end portion in the pull-out direction D2 of the storage portion 300. The cover-side project portion 33 composes the cover erroneous insertion blocking portion 30 (see FIG. 18A). The cover-side channel portion 34 also composes the cover erroneous insertion blocking portion 30 (see FIG. 18A).

Meanwhile, the abutment surface 204*a* of the cover member 200 abuts with the supporting surface 302 in a condition in which the cover member 200 is inserted into the apparatus body 1*a*. The engagement ribs 204*b* of the cover member 200 are placed on the guide ribs 304, respectively, on the both widthwise ends of the abutment surface 204*a* and are engageable with the guide ribs 304.

The insert portion 204 of the cover member 200 is inserted into the supporting portion 301 of the apparatus body 1*a* in inserting the cartridge 100 covered by the cover member 200 toward the insert position from the insertion slot portion 3 of the apparatus body 1*a*. In this condition, as the abutment surface 204*a* abuts with the supporting surface 302, the engage rib 204*b* is supported by the guide rib 304. That is, because the insert portion 204 is sandwiched vertically by the abutment surface 204*a* and the guide rib 304, the cover member 200 is restricted from moving in the vertical direction by the abutment surface 204*a* and the guide rib 304 in the condition as illustrated in FIG. 11A. The cover member 200 is also restricted from moving in the width direction W by the side walls 303 in the condition as illustrated in FIG. 11A. Then, the cover member 200 is guided toward the insert position by pushing the cover member 200 and the cartridge 100 in the insert direction D1 in this condition by the user.

Configuration of Cover Erroneous Insertion Blocking Portion

The configuration of the cover erroneous insertion blocking portion 30 serving as the first cover erroneous insertion blocking portion provided on the cover member 200 and the apparatus body 1*a* will be described below with reference to FIGS. 12 and 18A. Two sets of the cover erroneous insertion blocking portion 30 are provided on the cover member 200 and the apparatus body 1*a* in the present embodiment. However, a number of the sets of the cover erroneous insertion blocking portion is not limited to be two and may be one. One cover erroneous insertion blocking portion 30 is composed of the first channel portion 31 serving as the first portion provided on the apparatus body 1*a* and the cover-side project portion 33 serving as the second portion provided on the cover member 200. The other cover erroneous insertion blocking portion 30 is composed of the body-side project portion 32 serving as the first portion provided on the apparatus body 1*a* and the cover-side channel portion 34 serving as the second portion provided on the cover member 200.

It is noted that no erroneous insertion blocking portion is provided between the cartridge 100 and the cover member 200 in the present embodiment. Therefore, attachment parts of the cartridge 100 and the cover member 200 may be made common regardless of functional differences. This arrangement makes it possible to suppress an increase of production costs of the cartridge 100 and the cover member 200. Still further, because the cartridge 100 and the cover member 200 are normally assembled in a factory and are shipped as they are, chances of a user or others erroneously attaching the cartridge 100 with the cover member 200 are low.

The first channel portion 31 is provided inside of the storage portion 300 of the apparatus body 1*a*. The first channel portion 31 permits the cover member 200 to be inserted further into the apparatus body 1*a* without butting against the cover-side project portion 33 in a case where the cartridge 100 with the cover member 200 is inserted by a second distance Y2 which is shorter than the first distance Y1 from the insertion slot portion 3. Meanwhile, the body-side project portion 32 is provided inside of the storage portion 300 of the apparatus body 1*a*. The body-side project portion 32 permits the cover member 200 to be inserted further into the apparatus body 1*a* without butting against the cover-side channel portion 34 in a case where the cartridge 100 with the cover member 200 is inserted by the second distance Y2 from the insertion slot portion 3.

Here, because the cartridge 100, i.e., the first cartridge, is functionally compatible with the apparatus body 1*a*, the cover member 200 and the cartridge 100 can be inserted into the apparatus body 1*a* without being blocked by the cover erroneous insertion blocking portion 30. That is, the cover erroneous insertion blocking portion 30 permits the cover member 200 attached to the cartridge 100 to be inserted further in a case where the cartridge 100 attached with the cover member 200 is inserted by the second distance Y2 from the insertion slot portion 3. At this time, the first channel portion 31 and the body-side project portion 32 are disposed such that end portions in the pull-out direction D2 thereof match respectively with end portions in the insert direction D1 of the cover-side project portion 33 and the cover-side channel portion 34 in view from any direction orthogonal to the insert direction D1. Still further, at this time, the first channel portion 31 and the body-side project portion 32, and the cover-side project portion 33 and the cover-side channel portion 34 are disposed so as not overlap from each other in view from the insert direction D1.

Meanwhile, in a case where the cartridge is functionally incompatible with the apparatus body, an arrangement is made such that the cover member attached to such cartridge cannot be inserted. To that end, the arrangement is made such that at least one of the first channel portion 31 and the cover-side project portion 33 and the body-side project portion 32 and the cover-side channel portion 34 interfere with each other. In a case where the cartridge 100 of the present embodiment is erroneously inserted into the apparatus body functionally incompatible and not illustrated, at least one of the cover-side project portion 33 and the cover-side channel portion 34 of the cover member 200 interferes with the contact surface 306 of the apparatus body (see FIG. 19A). This arrangement makes it possible to suppress the cartridge 100 from being inserted into the other incompatible apparatus body. That is, the cover erroneous insertion blocking portion 30 restricts the cover member 200 attached to the cartridge 100 functionally incompatible with the apparatus body from being inserted further. It is noted that while the case where the cover erroneous insertion blocking portion 30 is composed of the project portion and the channel portion has been described in the present embodiment, the shapes interferable with each other are not limited to such combination. For instance, the cartridge 100 may be suppressed from being inserted into the other incompatible apparatus body by arranging such that the cover erroneous insertion blocking portion 30 includes only the project portion so as to pass through or interfere with the cartridge.

Configuration of Cartridge Erroneous Insertion Blocking Portion

A configuration of a cartridge erroneous insertion blocking portion 20, i.e., a first cartridge erroneous insertion blocking portion, provided in the cartridge 100 and in the apparatus body 1*a* will be described with reference to FIGS. 12 and 18B. The cartridge erroneous insertion blocking portion 20 is composed of a unit-side project portion 22 provided on the cartridge 100. As illustrated in FIG. 12, the second channel portion 21 is provided in a frame 307 of the apparatus body 1*a* and at the front end portion in the pull-out direction D2 of the frame 307 and is opened on the pull-out direction D2 side. The unit-side project portion 22 permits the cartridge 100 to be inserted further into the apparatus body 1*a* without butting against the second channel portion 21 in a case where the cartridge 100 from which the cover member 200 has been removed is inserted by a fifth distance Y5 from the insertion slot portion 3. It is noted that the fifth distance Y5 is set to be longer than the first distance Y1 and is a length between the third distance Y3 and a fourth distance Y4 in the present embodiment. That is, the distances from the insertion slot portion 3 are defined in order of the second distance Y2, the first distance Y1, the third distance Y3, the fifth distance Y5 and the fourth distance Y4.

Here, because the cartridge 100 is what is functionally compatible with the apparatus body 1*a*, the cover member 200 and the cartridge 100 can be inserted into the apparatus body 1*a* without being restricted by the cartridge erroneous insertion blocking portion 20. That is, in a case where the cartridge 100 from which the cover member 200 has been removed is inserted by the fifth distance Y5 from the insertion slot portion 3, the cartridge erroneous insertion blocking portion 20 permits the cartridge 100 to be inserted further. At this time, the second channel portion 21 and the unit-side project portion 22 are disposed such that the end face in the pull-out direction D2 of the second channel portion 21 matches with the end face in the insert direction D1 of the unit-side project portion 22 in any view orthogonal to the insert direction D1. Still further, at this time, the second channel portion 21 and the unit-side project portion 22 are disposed so as not to overlap with each other in view from the insert direction D1.

Meanwhile, in a case where the cartridge is functionally incompatible with the apparatus body, an arrangement is made such that the second channel portion 21 and the unit-side project portion 22 of the cartridge erroneous insertion blocking portion 20 interfere with each other so that the cartridge cannot be inserted. In a case where the cartridge 100 of the present embodiment is erroneously inserted into the apparatus body functionally incompatible with the cartridge 100 and not illustrated for example, the unit-side project portion 22 of the cartridge 100 interferes with the apparatus body (see FIG. 19B). This arrangement makes it possible to suppress the cartridge 100 from being inserted into the other incompatible apparatus body. That is, the cartridge erroneous insertion blocking portion 20 restricts the cartridge 100 functionally incompatible with the apparatus body from being inserted further into the apparatus body in the case where the cartridge 100 from which the cover member 200 has been removed is inserted by the fifth distance Y5 from the insertion slot portion 3. It is noted that while the case where the cartridge erroneous insertion blocking portion 20 is composed of the second channel portion 21 and the unit-side project portion 22 has been described in the present embodiment, shapes interferable with each other are not limited to such combination. For instance, the cartridge 100 may be suppressed from being inserted into the other incompatible apparatus body by arranging such that the cartridge erroneous insertion blocking portion 20 includes only the project portion so as to pass through or interfere with the cartridge.

Next, a procedure for inserting the cartridge 100 described above into the apparatus body 1*a* will be described in detail with reference to FIGS. 13A through 17B.

First Step

Figure 13A:
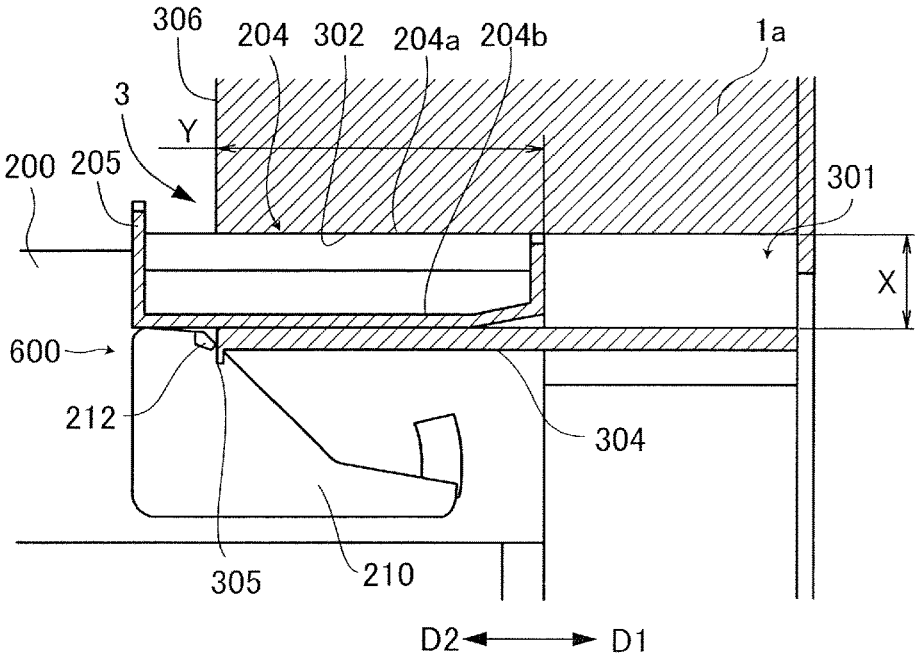
FIG. 13A is a longitudinal section view illustrating a relationship between an engage portion of a swing plate and a projecting portion of the apparatus body by which the drum cartridge of the embodiment is mounted to the apparatus body in a condition of a first step of mounting the drum cartridge to the apparatus body.

FIG. 13A illustrates a condition in which the cover member 200 and the cartridge 100 are inserted into the apparatus body 1*a* by a predetermined distance Y from the insertion slot portion 3 on the pull-out direction D2 side of the apparatus body 1*a*. At this time, the protrusion 211 of the swing plate 210 engages with the lock portion 105 of the cartridge 100, and the cartridge 100 is locked by the cover member 200 (see FIG. 7B). Then, the engagement portion 212 of the swing plate 210 provided in the cover member 200 butts against a front face of a projection 305 formed on a guide rib 304. It is noted that the front face of the projection 305 is a face of the projection 305 facing in the pull-out direction D2, i.e., a face in a front direction of the apparatus body 1*a*. A rear face of the projection 305 is a back side of the front face and is a face of the projection 305 in the insert direction D1, i.e., a face in a rear direction of the apparatus body 1*a*.

A gap X between the supporting surface 302 (See FIG. 18A) and an upper surface of the guide rib 304 is slightly larger than a gap between an abutment surface 204*a* of the insert portion 204 and a lower surface of the engage rib 204*b*, so that looseness between the insert portion 204 and the supporting portion 301 is small. Due to that, the cartridge 100 covered by the cover member 200 is supported by the apparatus body 1*a* in a condition in which the insert portion 204 is inserted into the supporting portion 301 by the predetermined distance Y. Thereby, even if the operator releases the cover member 200 and the cartridge 100, the cover member 200 and the cartridge 100 will not fall out of the apparatus body 1*a*.

Second Step

Figure 13B:
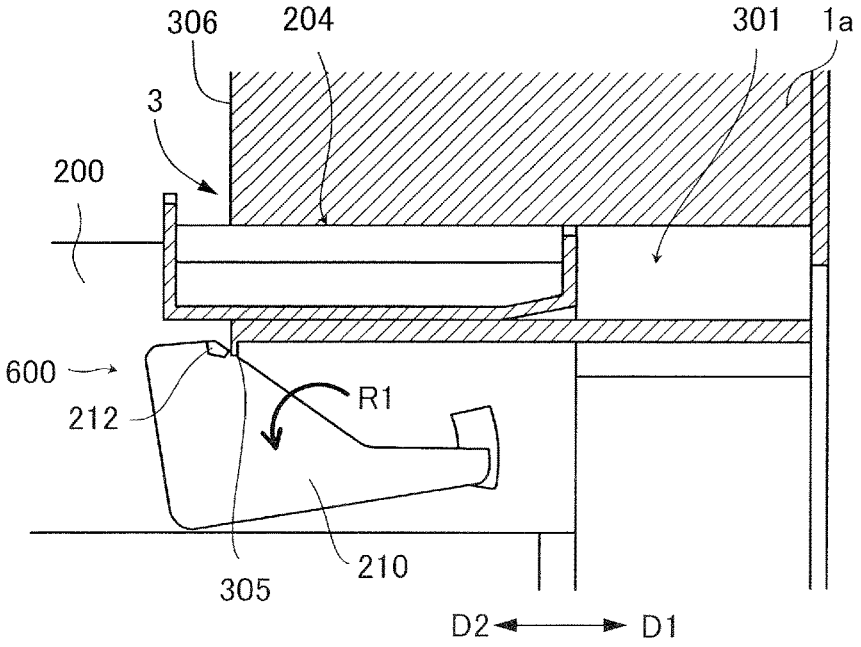
FIG. 13B is a longitudinal section view illustrating a relationship between an engage portion of a swing plate and a projecting portion of the apparatus body by which the drum cartridge of the embodiment is mounted to the apparatus body in a condition of a second step of mounting the drum cartridge to the apparatus body.

When the cover member 200 and the cartridge 100 are inserted further in the insert direction D1 from the condition as illustrated in FIG. 13A, the engagement portion 212 butts against the projection 305 and the swing plate 210 of the cover member 200 starts to turn in the unlock direction R1 as illustrated in FIG. 13B.

Third Step

When the cover member 200 and the cartridge 100 are inserted further in the insert direction D1, the swing plate 210 turns further in the unlock direction R1 and the engagement portion 212 passes under the projection 305 in the insert direction D1 as illustrated in FIG. 14A. At this time, the front end in the insert direction D1 of the cover member 200 and the cartridge 100 are inserted by the first distance Y1 from the insertion slot portion 3. Then, the contact portion 205 of the cover member 200 butts against the contact surface 306 of the supporting portion 301 which is a part of the apparatus body 1*a*, so that the cover member 200 is not inserted any more. It is noted that the position of the cover member 200 and the cartridge 100 at this time is defined as a reference position. Still further, the protrusion 211 is disengaged from the lock portion 105 and the cover member 200 is unlocked from the cartridge 100 as illustrated in FIG. 14B. Due to that, the cartridge 100 becomes movable in the insert direction D1 with respect to the cover member 200.

Figure 17A:
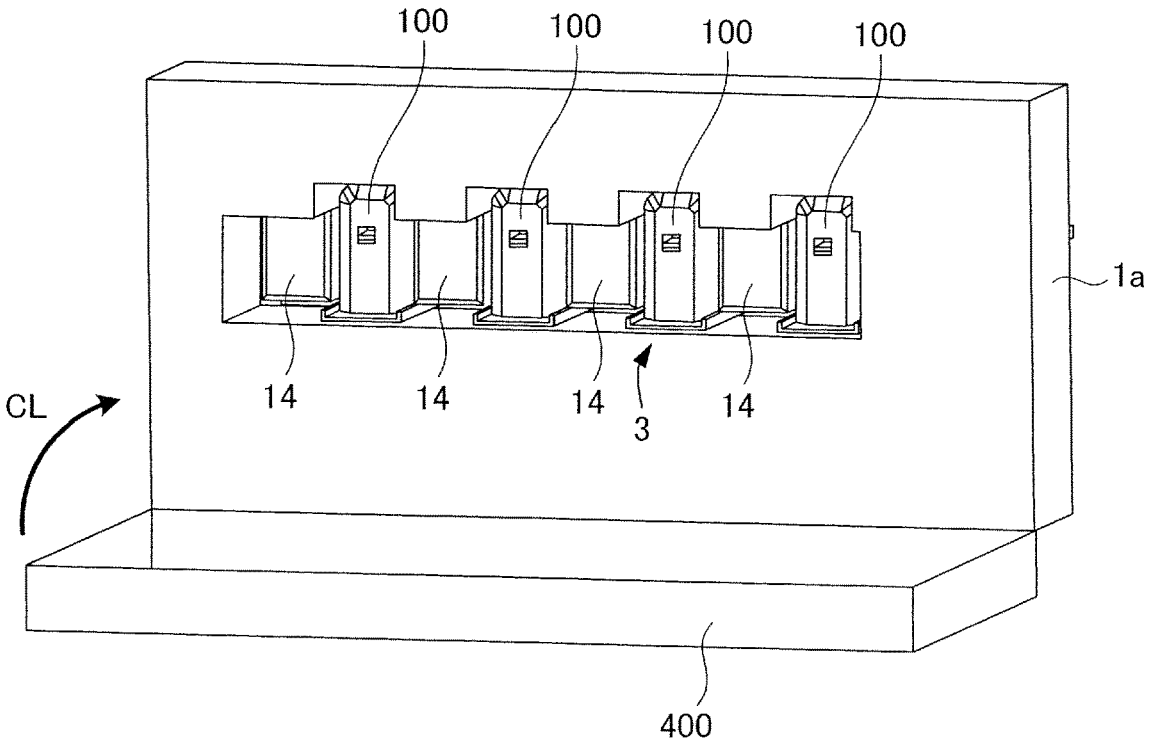
FIG. 17A is a perspective view illustrating a part of the apparatus body of the present embodiment in a condition in which the drum cartridge is mounted to the apparatus body.

According to the present embodiment, when the cartridge 100 covered by the cover member 200 is disposed at the reference position, i.e., at the position in FIG. 17A, the cover member 200 is unlocked from the cartridge 100. Thus, the image forming apparatus 1 comprises a unit locking mechanism 500 serving as a unit lock portion of locking and unlocking the cartridge 100 and the cover member 200. The unit locking mechanism 500 is composed of the engagement portion 212, the projection 305 serving as an engaged portion, the swing plate 210 serving as a moving unit, the protrusion 211 and the lock portion 105.

The engagement portion 212 is provided in the cover member 200 as described above. The projection 305 serving as the engaged portion is provided in the apparatus body 1*a* and is engageable with the engagement portion 212. The swing plate 210 is provided with the engagement portion 212 and is disposed movably (swingably) with respect to the cover member 200. The protrusion 211 is provided on the swing plate 210 and protrudes toward the cartridge 100 covered by the cover member 200. The lock portion 105 is engageable with the protrusion 211 and locks the cartridge 100 with the cover member 200 in the condition in which the lock portion 105 is engaged with the protrusion 211. When the cartridge 100 covered by the cover member 200 is disposed at the reference position, the engagement portion 212 engages with the projection 305, so that the swing plate 210 moves and the protrusion 211 is disengaged from the lock portion 105.

Figure 17B:
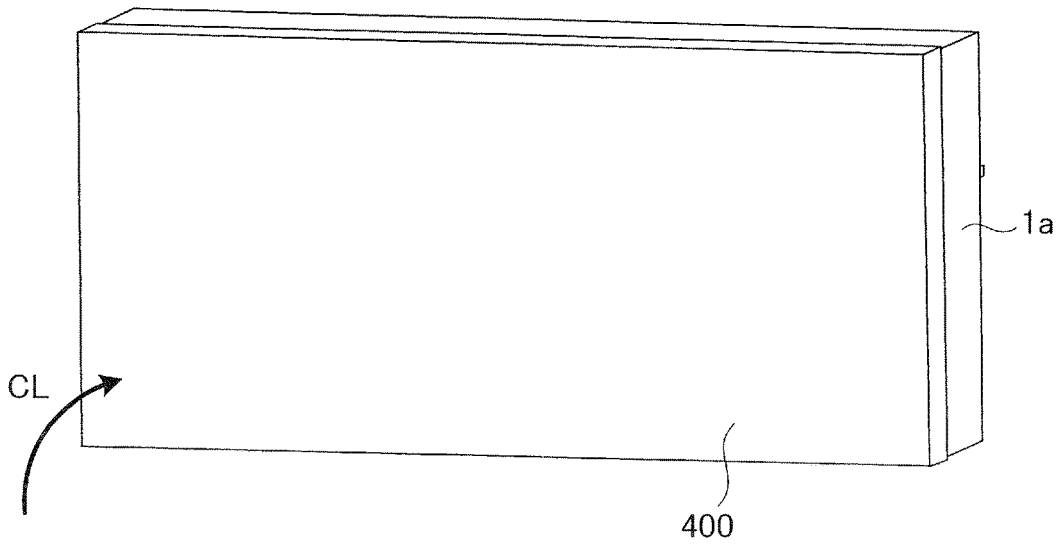
FIG. 17B is a perspective view illustrating a condition in which the front cover is closed.

As illustrated in FIG. 17B, a release portion 105*a* dented upward more than a lock guide portion 104 is formed above the lock portion 105. Due to that, the protrusion 211 is movable upward more than the position of the lock guide portion 104 and corresponding to that, the swing plate 210 also becomes swingable in the unlock direction R1. As a result, the position of the engagement portion 212 can be lowered with respect to the projection 305, enabling to disengage the engagement portion 212 from the projection 305 more reliably.

Because the protrusion 211 is disengaged from the lock portion 105, the cartridge 100 unlocked from the cover member 200 becomes insertible into the apparatus body 1*a* while being guided by the cover member 200. As illustrated in FIG. 7A, the rib 102 of the cartridge 100 engages with the drum guide 202*a* of the cover member 200, and the guide 103 of the cartridge 100 engages with the holding rib 203*a* of the cover member 200. Due to that, the cartridge 100 can be inserted into the apparatus body 1*a* while being guided by the cover member 200 by the engagement of these members.

Fourth Step

Figure 15A:
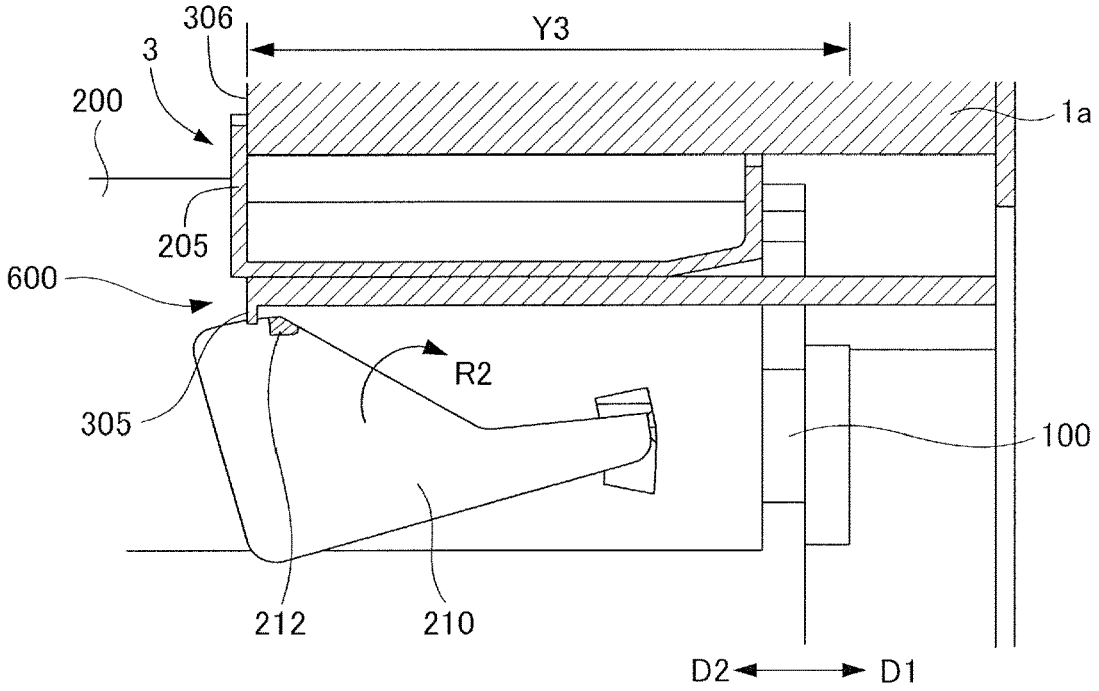
FIG. 15A is a section view illustrating the relationship between the engage portion of the swing plate and the projecting portion of the apparatus body in a condition of a fourth step of mounting the drum cartridge of the present embodiment to the apparatus body.
Figure 15B:
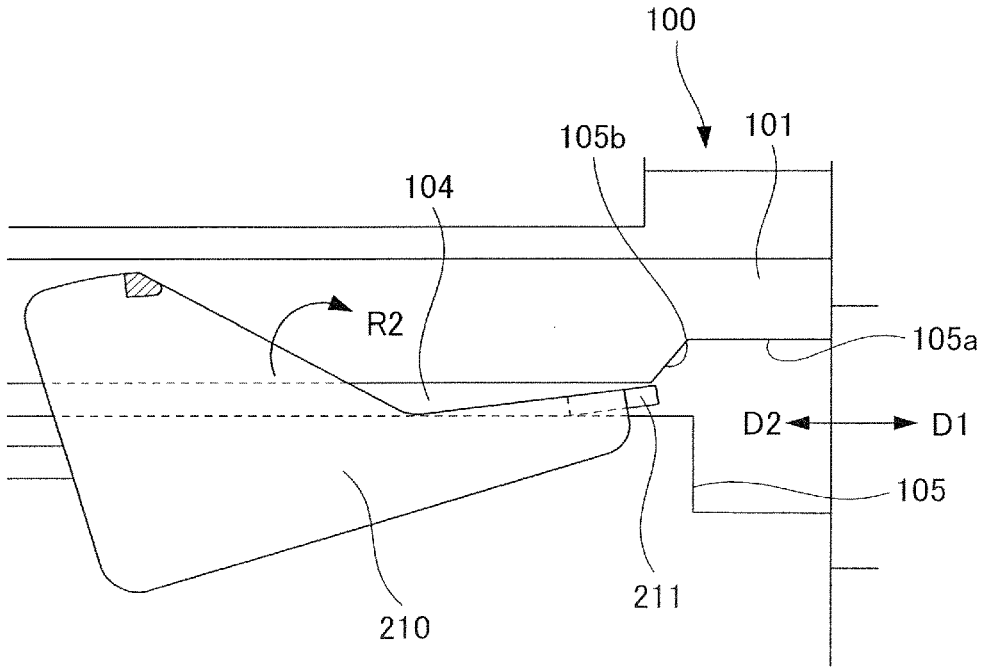
FIG. 15B is a side view illustrating a relationship between the protrusion of the swing plate and a lock guide portion of the apparatus body.

Only the cartridge 100 is inserted toward the rear side of the apparatus body 1*a* by the third distance Y3 from the insertion slot portion 3 from the reference position indicated in FIG. 14A. At this time, the protrusion 211 located above the lock guide portion 104 due to the release portion 105*a* is engaged with the lock guide portion 104 by being guided to an inclined portion 105*b* formed between the release portion 105*a* and the lock guide portion 104 as illustrated in FIG. 15B. Thereby, the swing plate 210 swings in the lock direction R2 and the engagement portion 212 that has previously passed under the projection 305 rises to a level engageable with the rear face of the projection 305 as illustrated in FIG. 15A. Due to that, even if the cover member 200 is tried to be moved in the pull-out direction D2, the move is restricted by the engagement portion 212 butting against the rear face of the projection 305. Still further, even if the cover member 200 is tried to be moved in the insert direction D1, the cover member 200 is not inserted further because the contact portion 205 butts against the contact surface 306 of the apparatus body 1*a*. Due to that, the cover member 200 is locked to the apparatus body 1*a* in the insert direction D1 and the pull-out direction D2 and cannot be taken out of the apparatus body 1*a*.

According to the present embodiment, the image forming apparatus 1 comprises a body locking mechanism 600 serving as a body locking unit configured to lock and unlock the apparatus body 1*a* and the cover member 200. The body locking mechanism 600 is composed of the engagement portion 212 and the projection 305 serving as the engaged portion. Then, in a case where the cartridge 100 attached with the cover member 200 is inserted by the third distance Y3 from the insertion slot portion 3 by being guided by the guide rail 410, the body locking mechanism 600 locks the apparatus body 1*a* with the cover member 200. Meanwhile, in a case where the cartridge 100 is inserted by the fourth distance Y4 from the insertion slot portion 3 by being guided by the guide rail 410, the body locking mechanism 600 unlocks the cover member 200 from the apparatus body 1*a*.

The body locking mechanism 600 is composed of the swing plate 210 serving as the moving unit, the protrusion 211, the lock guide portion 104 and the unlock guide portion 106. The lock guide portion 104 is formed approximately in parallel with the insert direction D1 in a range in which the cartridge 100 moves with respect to the cover member 200 to a position not including the position of the fourth distance Y4 from the third distance Y3 until the fourth distance Y4. Then, when the cartridge 100 moves within this range, the lock guide portion 104 engages with and guides the protrusion 211 such that the swing plate 210 is kept at the engage position where the engagement portion 212 is engaged with the projection 305. Meanwhile, in a case where the cartridge 100 moves to the position of the fourth distance Y4, the unlock guide portion 106 engages with and guides the protrusion 211 such that the swing plate 210 is moved to the disengage position where the engagement portion 212 is disengaged from the projection 305. This point will be described later.

Thus, according to the present embodiment, the body locking mechanism 600 is common with the unit locking mechanism 500 in terms of the configurations of the engagement portion 212, the projection 305, the swing plate 210 and the protrusion 211. The lock guide portion 104 and the unlock guide portion 106 are grooves defined continuously from the lock portion 105. Therefore, the body locking mechanism 600 and the unit locking mechanism 500 have the mechanically common configuration.

Here, it is unable to pull the cover member 200 out of the apparatus body 1*a*, even if the cover member 200 is tried to be pulled out from the apparatus body 1*a* in the condition in which the cover member 200 is locked to the apparatus body 1*a*. That is, because the swing plate 210 is restricted from swinging by the protrusion 211 engaged with the lock guide portion 104 as illustrated in FIG. 18B, the condition in which the engagement portion 212 is engaged with the rear face of the projection 305 as illustrated in FIG. 18A is maintained. Therefore, it is unable to pull the cover member 200 out of the apparatus body 1*a*.

Meanwhile, in a case where the cartridge 100 that has been inserted by more than the third distance Y3 from the insertion slot portion 3 is returned to the reference position, the cover member 200 is unlocked from the apparatus body 1*a*. That is, in a case where the cartridge 100 is returned to the reference position, the protrusion 211 moves to a region of the lock portion 105 on the front end side in the insert direction D1 more than the lock guide portion 104 as illustrated in FIG. 17B. As a result, the swing plate 210 becomes swingable in the unlock direction R1 and the engagement portion 212 is disengaged from the projection 305 as illustrated in FIG. 17A, so that the cover member 200 is unlocked from the apparatus body 1*a*. Accordingly, it is possible to take the cover member 200 and the cartridge 100 out of the apparatus body 1*a* by returning the cartridge 100 to the reference position.

It is noted that while it has been described that the body locking mechanism 600 for locking the apparatus body 1*a* with the cover member 200 is unlocked in the case where the cartridge 100 which has been inserted by more than the third distance Y3 from the insertion slot portion 3 is returned to the reference position, the present disclosure is not limited to such configuration. For instance, it may be configured such that the cover member 200 is not unlocked from the apparatus body 1*a* even if the cartridge 100 is returned to the reference position.

It is noted that the third distance Y3 from the insertion slot portion 3 may be a distance by which the cartridge 100 has substantially moved in the insert direction D1 with respect to the cover member 200 more than the reference position indicated in FIG. 14A. That is, the operator may lock the cover member 200 with the apparatus body 1*a* by pushing only the cartridge 100 from the condition in which the cartridge 100 and the cover member 200 are set at the reference position. However, there is a case where only the cartridge 100 moves slightly in the insert direction D1 by momentum and others when the operator sets the cartridge 100 and the cover member 200 at the reference position. It is not preferable to lock the cover member 200 also in such a case. Therefore, the third distance Y3 is set as a length of degree of not locking the cover member 200 and the apparatus body 1*a* in a case where the cartridge 100 slightly moves as described above. Accordingly, the third distance Y3 is set to be greater than the looseness in the insert direction D1 between the cartridge 100 and the cover member 200 for example.

Fifth Step

Figure 16A:
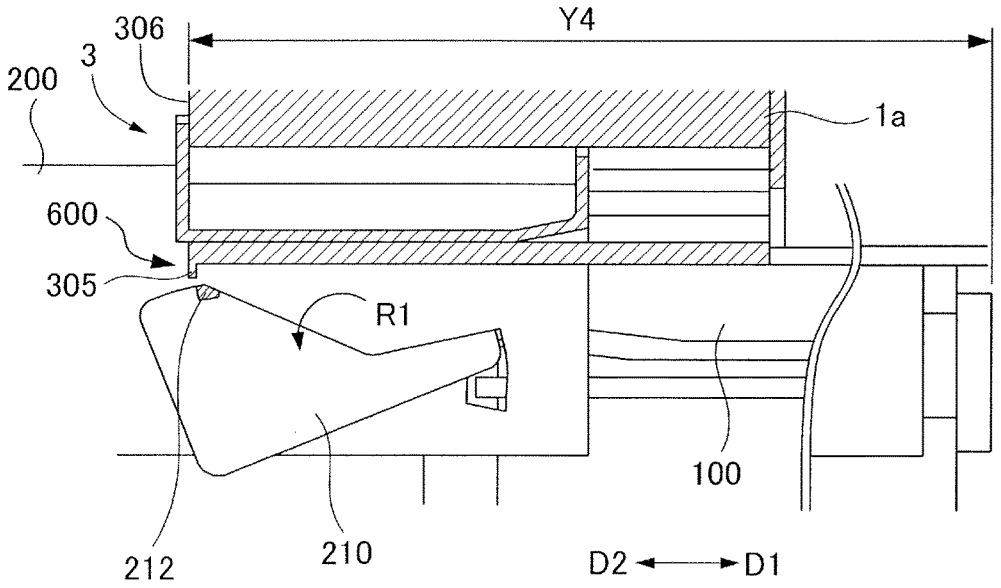
FIG. 16A is a section view illustrating the relationship between the engage portion of the swing plate and the projecting portion of the apparatus body in a condition of a fifth step of mounting the drum cartridge of the present embodiment to the apparatus body.
Figure 16B:
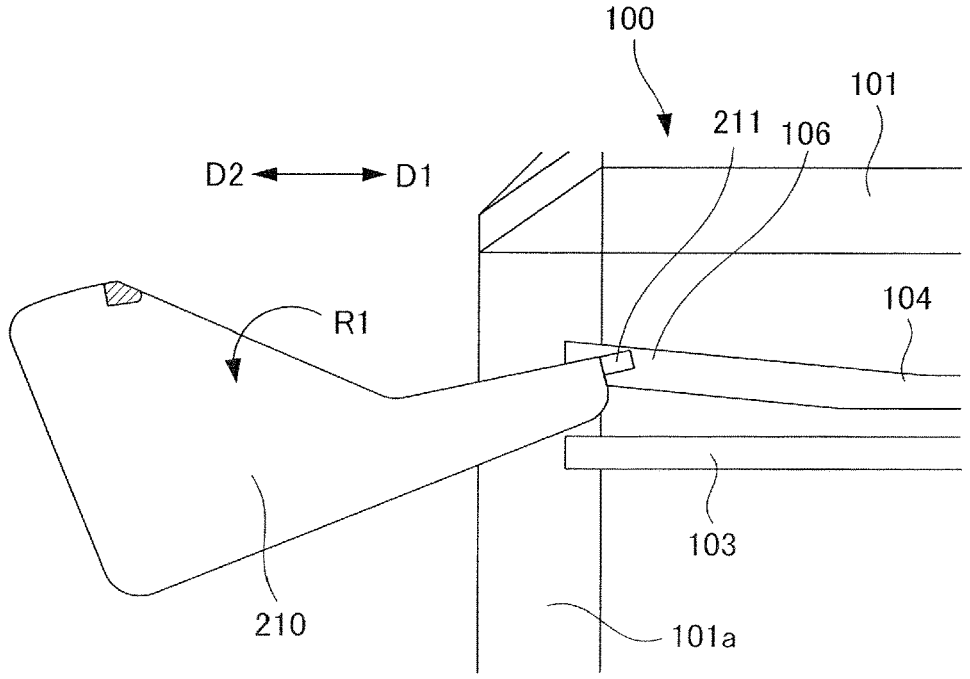
FIG. 16B is a side view illustrating a relationship between the protrusion of the swing plate and an unlock guide portion of the apparatus body.

Only the cartridge 100 is inserted toward the rear side of the apparatus body 1*a* further from the condition as illustrated in FIG. 15A. When the cartridge 100 is inserted by the fourth distance Y4 which is longer than the third distance Y3 from the insertion slot portion 3, the protrusion 211 of the swing plate 210 relatively moves with respect to the cartridge 100 and is guided to the unlock guide portion 106 as illustrated in FIG. 16B. Because the unlock guide portion 106 inclines upward more than the lock guide portion 104 in the pull-out direction D2, the swing plate 210 turns in the unlock direction R1 as the protrusion 211 is engaged with and guided by the unlock guide portion 106. As illustrated in FIG. 16A, the engagement portion 212 of the swing plate 210 moves to a position under the projection 305, i.e., a disengage position, where the engagement portion 212 does not engage with the projection 305, so that the cover member 200 is unlocked from the apparatus body 1*a* and it becomes possible to take the cover member 200 out of the apparatus body 1*a*.

The guide 103 and the unlock guide portion 106 formed on the other side surface 101R of the housing 101 of the cartridge 100 are opened to the pull-out direction D2 side of the other side surface 101R. Here, as illustrated in FIG. 2A, the both side surfaces 101L and 101R of the housing 101 are continuous respectively to an end face of the housing 101 on the pull-out direction D2 side by inclined faces 101*a*. The pair of inclined faces 101*a* inclines such a distance between the inclined faces 101*a* becomes narrow in the pull-out direction D2. Accordingly, the guide 103 and the unlock guide portion 106 are provided so as to intrude into the inclined face 101*a* by their depths.

This arrangement makes it possible for the holding rib 203*a* and the protrusion 211 respectively engaging with the guide 103 and the unlock guide portion 106 to be pulled out of the guide 103 and the unlock guide portion 106 on the pull-out direction D2 side. Still further, as illustrated in FIGS. 4B and 5A, a drum guide 202*a* formed on the cover member 200 is also opened on the pull-out direction D2 side of the cover member 200. This arrangement makes it possible for the rib 102 of the cartridge 100 engaging with the drum guide 202*a* to be pulled out on the pull-out direction D2 side from the drum guide 202*a*. Thereby, the cover member 200 can be also removed out of the cartridge 100 in taking the cover member 200 out of the apparatus body 1*a*. That is, it is possible to take the cover member 200 out of the apparatus body 1*a* and the cartridge 100 just by inserting the cartridge 100 by the fourth distance Y4 from the insertion slot portion 3.

It is noted that the distances from the insertion slot portion 3 are set in order of the second distance Y2, the first distance Y1, the third distance Y3, the fifth distance Y5 and the fourth distance Y4. Preferably, the fourth distance Y4 is a distance until when the cartridge 100 is inserted into the predetermined mount position of the apparatus body, that is, a distance to the mount position to which the cartridge 100 is inserted. At the predetermined mount position, the locking hook 411 of the apparatus body 1*a* is engaged with the engage hole 16*a* of the cartridge 100, and the cartridge 100 is locked to the apparatus body 1*a* as illustrated in FIG. 10. Therefore, it is possible to prevent the cartridge 100 from being pulled out carelessly in taking the cover member 200 out of the apparatus body 1*a*.

However, the fourth distance Y4 is not limited to be the distance until when the cartridge 100 is inserted into the mount position. For instance, the fourth distance Y4 may be a distance to a position where a center of gravity of the cartridge 100 enters the apparatus body 1*a*. The position where the center of gravity of the cartridge 100 enters the apparatus body 1*a* is a position where the center of gravity of the cartridge 100 rides on the guide rail 410 of the apparatus body 1*a* for example. If the center of gravity of the cartridge 100 is located on the guide rail 410 of the apparatus body 1*a*, it is possible to prevent the cartridge 100 from falling out of the apparatus body 1*a* even when the cover member 200 is taken out. Still further, in the case where the cartridge 100 includes the photosensitive drum 11 like the present embodiment, the fourth distance Y4 may be a position where the photosensitive drum 11 is stored in the apparatus body 1*a*. That is, as long as the photosensitive drum 11 is stored within the apparatus body 1*a*, the photosensitive drum 11 is hardly exposed outside even if the cover member 200 is taken out and the photosensitive drum 11 is hardly damaged or is exposed to light in inserting the cartridge 100.

Figure 20A:
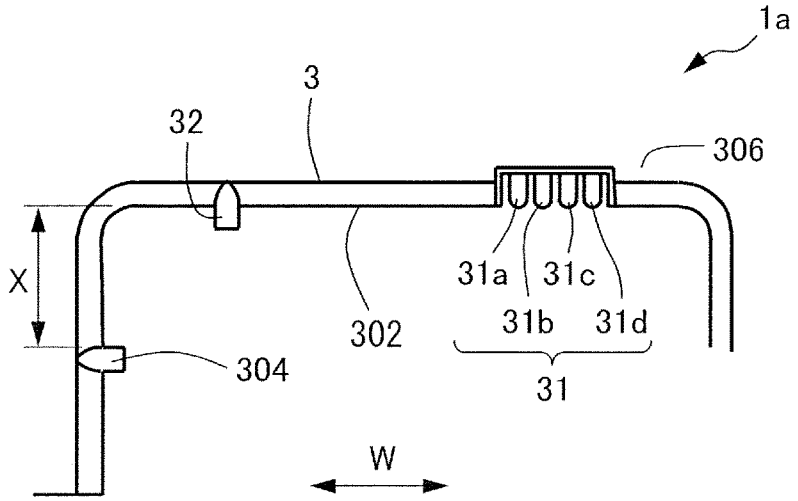
FIG. 20A is a section view illustrating an engage portion of an apparatus body engaging with a cover member before processing of a modified example of the embodiment.
Figure 20B:
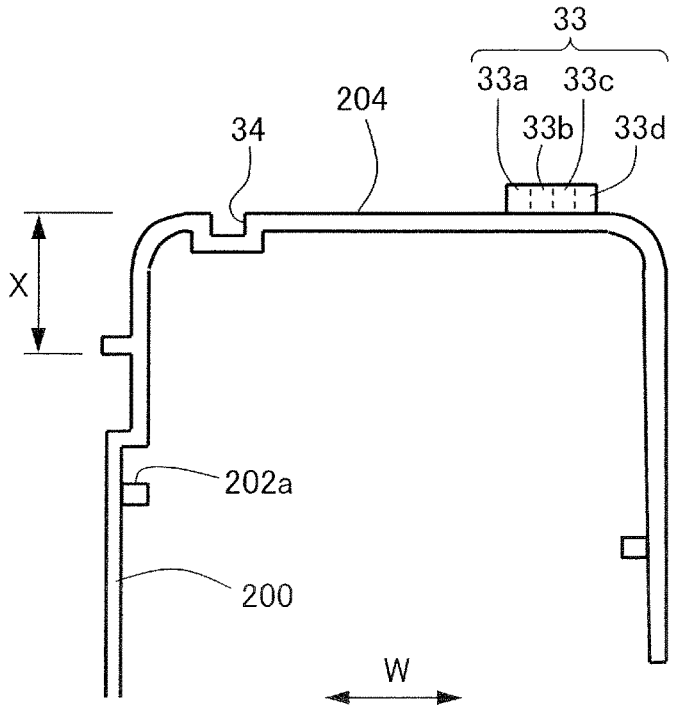
FIG. 20B is a section view illustrating the engage portion of the cover member.
Figure 21A:
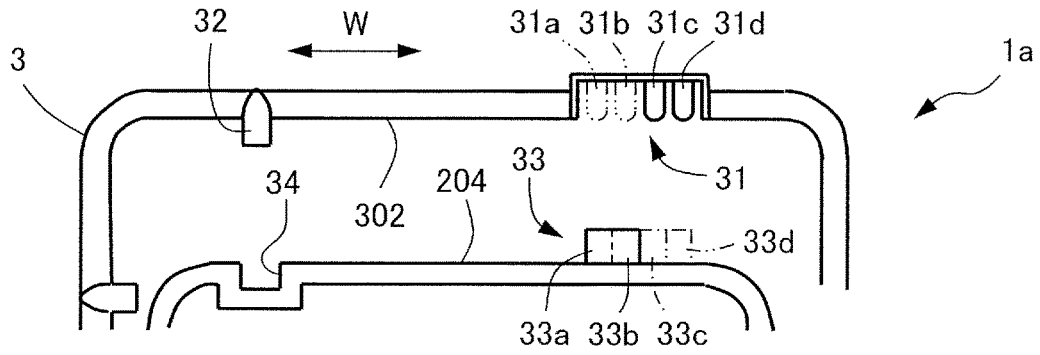
FIG. 21A is a section view illustrating a first pattern of ribs of the engage portion between the apparatus body and the cover member of the modified example of the embodiment in which first and second ribs of the first channel portion are removed and third and fourth ribs of a cover-side projection are removed.
Figure 21B:
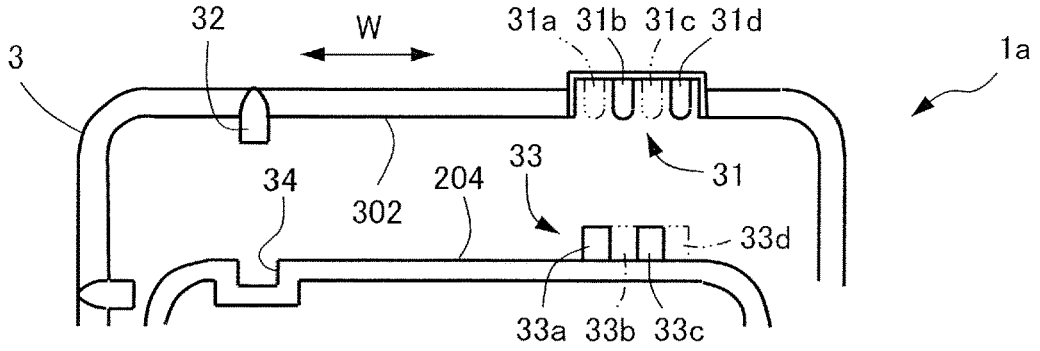
FIG. 21B is a section view illustrating a second pattern in which the first and third ribs of the first channel portion are removed and second and fourth ribs of the cover-side projection are removed.
Figure 21C:
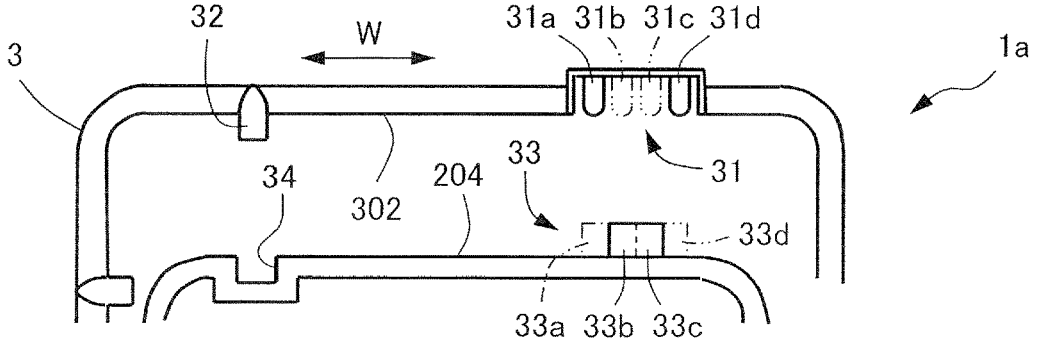
FIG. 21C is a section view illustrating a third pattern in which the second and third ribs of the first channel portion are removed and the first and fourth ribs of the cover-side projection are removed.
Figure 22A:
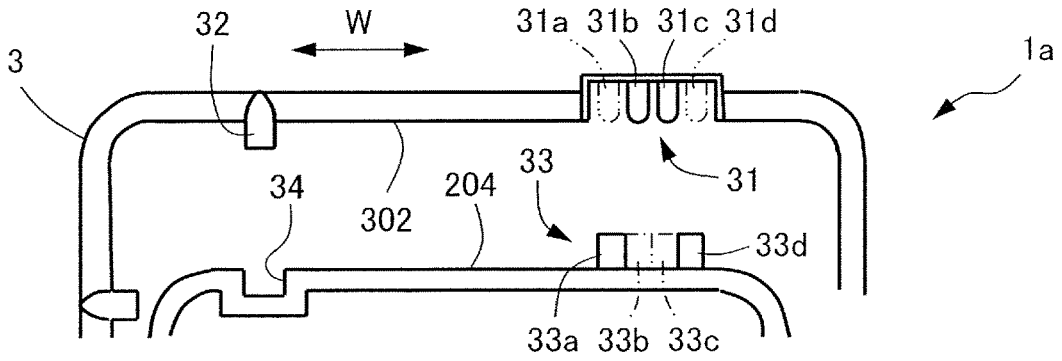
FIG. 22A is a section view illustrating a fourth pattern of ribs of the engage portion between the apparatus body and the cover member of the modified example of the embodiment in which the first and fourth ribs of the first channel portion are removed and the second and third ribs of the cover-side projection are removed.
Figure 22B:
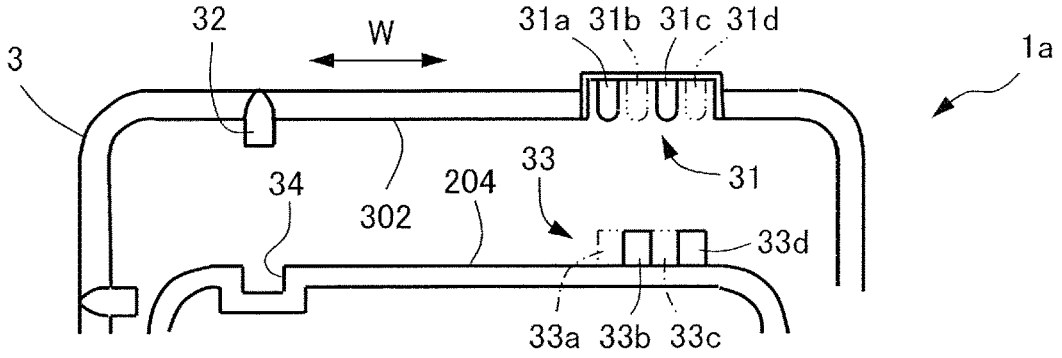
FIG. 22B is a section view illustrating a fifth pattern in which the second and fourth ribs of the first channel portion are removed and the first and third ribs of the cover-side projection are removed.
Figure 22C:
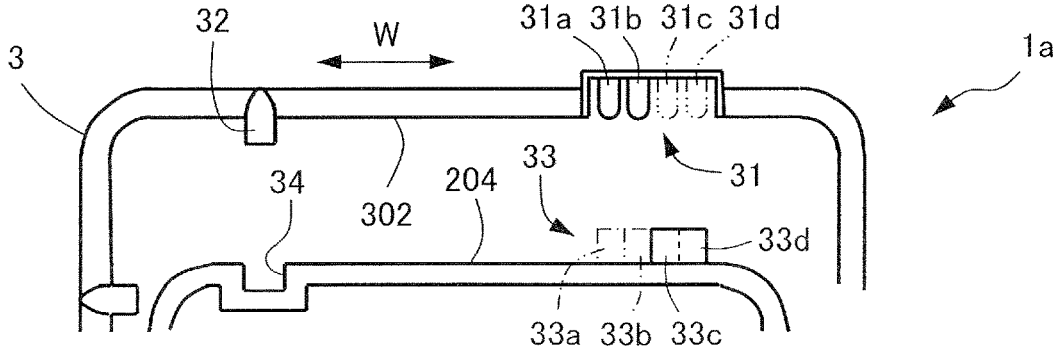
FIG. 22C is a section view illustrating a sixth pattern in which the third and fourth ribs of the first channel portion are removed and the first and second ribs of the cover-side projection are removed.

On and after inserting the cartridge 100 by the fourth distance Y4 from the insertion slot portion 3, the cover member 200 is taken out of the apparatus body 1*a* and the cartridge 100. According to the present embodiment, the cover member 200 is taken out after inserting the cartridge 100 to the predetermined mount position. As a result, the cartridge 100 is mounted to the predetermined mount position as illustrated in FIG. 20A, and then the replacing works of the cartridge 100 is completed by closing the front cover 400 in the direction CL as illustrated in FIG. 20B.

Inserting Drum Cartridge Having Different Function into Apparatus Body

Next, the cover erroneous insertion blocking portion 30 and the cartridge erroneous insertion blocking portion 20 of the apparatus body 1*a* of the present embodiment will be described with reference to FIGS. 19A and 19B. Normally, it is necessary to differentiate the photosensitive layer of the photosensitive drum, toner and others depending on image forming speed. It is also necessary to design an angle of contact of the cleaning blade with the surface of the photosensitive drum and durability of the coupling for rotating the photosensitive drum corresponding to the image forming speed. To that end, for image forming apparatuses with different image forming speed, it is necessary to mount a cartridge compatible with each apparatus. Still further, as another exemplary case, it is conceivable a case where the apparatus body 1*a* is marketed in either specification of a color image forming apparatus and a monochrome image forming apparatus. In a case where the apparatus body 1*a* is used as the color image forming apparatus, it is necessary to mount a black cartridge including the light guide 107 in the apparatus so that a destaticization control is reliably made. In a case where the apparatus body 1*a* is used as the monochrome image forming apparatus, a black cartridge not including the light guide 107 should be mounted for the user using an apparatus thereof by considering an aspect of cost. Then, for common usage of the case of the cartridges, cartridges functionally different, even though having identical cover members in shape, may exist from the aspect described above. For instance, even if cartridges can be inserted into an apparatus body by being guided by a guide rail, there may be a case where a photosensitive drum of the cartridge is not compatible with a specification of the apparatus body and does not operate adequately. Then, a case where the same cover member is commonly used for a plurality of cartridges having different functions and the cartridges can be mounted to a plurality of apparatus bodies having different functions will be described.

That is, an apparatus body 1*b* different from the apparatus body 1*a* described above includes a second holding portion for guiding and holding a second cover member by being compatible in shape with the second cover member in a case where the second cover member is inserted into the apparatus body 1*b* from a second insertion slot portion of the apparatus body 1*b*. While he cover member 200 is compatible in shape with the second holding portion, it is restricted from being guided by the second holding portion by the second cartridge erroneous insertion blocking portion of the apparatus body 1*b*, i.e., the second apparatus body.

Figure 19A:
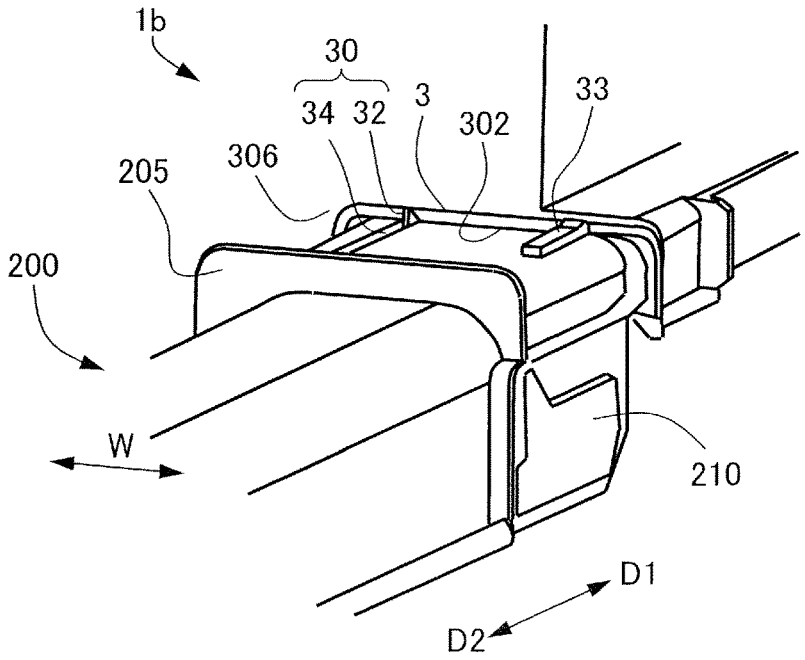
FIG. 19A is a perspective view illustrating an engagement portion of the cover member side engaging with the drum cartridge incompatible with the apparatus body of the present embodiment.
Figure 19B:
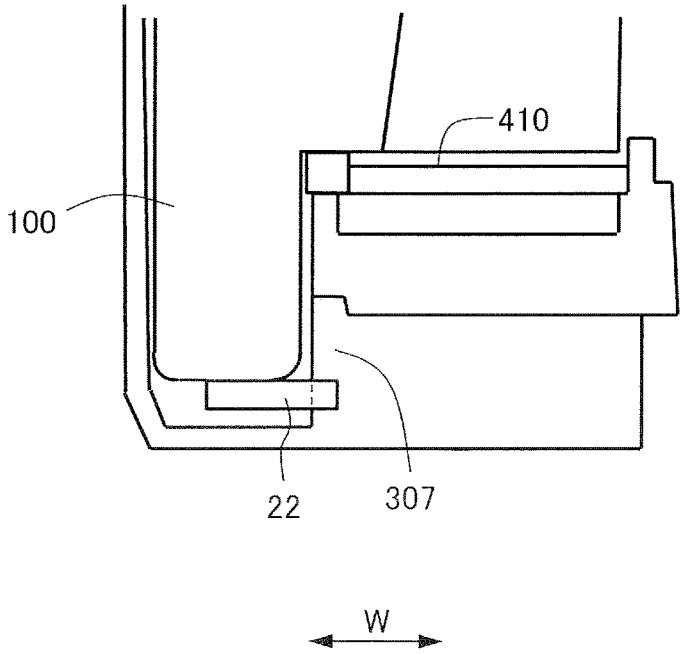
FIG. 19B is a section view illustrating the engagement portion of the drum cartridge side.

As illustrated in FIG. 19A, in a case where the cartridge 100 is inserted into the apparatus body 1*b* in the insert direction D1 by the second distance Y2 from the insertion slot portion 3, the cover-side project portion 33 of the cartridge 100 interferes with the contact surface 306 of the apparatus body 1*b*. Here, the body-side project portion 32 passes through without interfering with the cover-side channel portion 34. Thereby, the cover member 200 and the cartridge 100 cannot be inserted further and cannot be mounted to the apparatus body 1*b*. As a result, it is possible to realize incompatibility of suppressing such erroneous insertion in inserting the cartridge 100 into the functionally different apparatus body 1*b*. That is, the cover erroneous insertion blocking portion 30 restricts the cartridge 100 functionally incompatible with the apparatus body 1*b* from being inserted further. That is, in a case where the cartridge 100 is inserted by the second distance Y2 from the insertion slot portion 3, the cover erroneous insertion blocking portion 30 disables the cartridge 100 from being inserted into the apparatus body 1*b* by butting the cover-side project portion 33 against the contact surface 306. Thereby, it is possible to suppress a condition in which the cartridge 100 cannot be taken out of the apparatus body 1*b* from occurring because the cover erroneous insertion blocking portion 30 becomes operative at a position apart from the insertion slot portion 3 by the second distance Y2 before when a body lock mechanism 600 becomes operative. That is, the apparatus body 1*b* includes a fourth portion, and the second cover member compatible with the second drum cartridge that is compatible with the apparatus body 1*b* includes a third portion on outside thereof. The second cover member is restricted from being inserted because the cover-side project portion 33 and the cover-side channel portion 34 butt against the fourth portion of the apparatus body 1*b*.

Here, normally the cartridge 100 to be mounted is attached with the cover member 200, there is a possibility that the cover member 200 is removed from the cartridge 100 by unlocking the unit lock mechanism 500 by erroneous operation of the user or the like. In this case, because the cover erroneous insertion blocking portion 30 does not function even if the cartridge 100 from which the cover member 200 has been removed is inserted into the apparatus body 1*b*, the incompatible cartridge 100 may end up being mounted to the apparatus body 1*b* as it is.

However, because the cartridge erroneous insertion blocking portion 20 is provided in the present embodiment, it is possible to suppress the cartridge 100 from which the cover member 200 has been removed to be erroneously inserted even if the cartridge 100 is tried to be inserted into the apparatus body 1*b*. That is, even if the cartridge 100 from which the cover member 200 has been removed is inserted from the insertion slot portion 3 and passes through the second distance Y2, the cover erroneous insertion blocking portion 30 does not function and the cartridge 100 passes through the first distance Y1. At this time, the cover member 200 is not locked to the apparatus body 1*b* because the cover member 200 has been removed. Then, when the cartridge 100 from which the cover member 200 has been removed is inserted by the fifth distance Y5, the unit-side project portion 22 butts against the frame 307, disabling the cartridge 100 from being inserted into the apparatus body 1*b*. Because the fifth distance Y5 is shorter than the fourth distance Y4, the cartridge 100 is suppressed from being mounted before completely inserted into the apparatus body 1*b* in trying to mount only by the cartridge 100. Because the front cover 400 does not close in this condition and the replacing work cannot be finished by closing the front cover 400, it is possible to inform the user or the like of that the drum cartridge is an incompatible drum cartridge.

That is, the second guide portion guides the second drum cartridge because the second guide portion is compatible in shape with the drum cartridge in a case where the second drum cartridge is inserted into the apparatus body 1*b* from the second insertion slot portion of the apparatus body 1*b*. While the cartridge 100 is compatible in shape respectively with the second guide portion and the guide rail 410, the cartridge 100 is restricted from being inserted into the apparatus body 1*b* by the second cartridge erroneous insertion blocking portion of the apparatus body 1*b*. The first cartridge erroneous insertion blocking portion 20 of the apparatus body 1*a* restricts the second drum cartridge, which is permitted to be inserted into the apparatus body 1*b* by the second cartridge erroneous insertion blocking portion, from being inserted into the apparatus body 1*a*.

As described above, according to the image forming apparatus 1 of the present embodiment, the cover erroneous insertion blocking portion 30 restricts the cover member of the drum cartridge compatible with the apparatus body 1*b* functionally different from the apparatus body 1*a* from being guided by the range exceeding the second distance Y2 which is shorter than the first distance Y1. This arrangement makes it possible to suppress the drum cartridge incompatible with the apparatus body from being erroneously inserted.

Still further, according to the image forming apparatus 1 of the present embodiment, in a case where the cartridge 100 attached with the cover member 200 is inserted into the apparatus body 1*a* and is then inserted by the second distance Y2 before when the apparatus body 1*a* is locked with the cover member 200, the cover erroneous insertion blocking portion 30 operates as follows. In this case, the cover erroneous insertion blocking portion 30 permits the cover member 200 attached to the compatible cartridge 100 to be inserted further and restricts the incompatible cartridge from being inserted further. This arrangement makes it possible to readily take the cartridge 100 and the cover member 200 out of the apparatus body 1*b* even if the cartridge 100 incompatible with the apparatus body 1*b* is tried to be erroneously mounted and is disabled to be inserted by the cover erroneous insertion blocking portion 30.

Still further, according to the image forming apparatus 1 of the present embodiment, the cartridge 100, from which the cover member 200 has been removed and is inserted from the insertion slot portion 3, passes through the first distance Y1 because the cover erroneous insertion blocking portion 30 does not function even if the cartridge 100 passes through the second distance Y2. However, because of the cartridge erroneous insertion blocking portion 20, it is possible to suppress the cartridge 100 from being erroneously inserted into the apparatus body 1*b* even if the cartridge 100 from which the cover member 200 has been removed is inserted into the apparatus body 1*b*. Still further, because the cover member 200 has been removed, the apparatus body 1*b* is not locked with the cover member 200.

Still further, according to the image forming apparatus 1 of the present embodiment, the cover erroneous insertion blocking portion 30 and the cartridge erroneous insertion blocking portion 20 are both composed of the combination of the channel portion and the project portion. Therefore, this arrangement makes it possible to suppress the increases of size and production costs of the apparatus because it is possible to suppress the cartridge from being erroneous inserted by the simple shape.

Still further, according to the image forming apparatus 1 of the present embodiment, the cover member 200 is locked by the apparatus body 1*a* when the cartridge 100 is inserted by the third distance Y3 from the insertion slot portion 3. The cover member 200 is kept being locked by the apparatus body 1*a* until when the cartridge 100 is inserted by the fourth distance Y4. Therefore, the cover member 200 will not be removed out of the apparatus body 1*a* carelessly in inserting the cartridge 100, and the cartridge 100 can be mounted to the predetermined mount position while being guided and inserted by the cover member 200.

Here, in a case where the cover erroneous insertion blocking portion 30 is provided so as to be operative on the rear side in the insert direction D1 more than the third distance Y3, the cartridge 100 may be erroneously inserted into the apparatus body functionally incompatible with the cartridge 100 by more than the third distance Y3. In this case, there is a possibility that the body locking mechanism 600 becomes operative to the cover member 200 and the apparatus body, the body locking mechanism 600 cannot be unlocked unless the cartridge 100 is inserted into the apparatus body, and the cover member supporting the cartridge 100 cannot be taken out of the apparatus body. Meanwhile, according to the image forming apparatus 1 of the present embodiment, the relationship of the positions of the cartridge 100 from the insertion slot portion 3 is set in order of the second distance Y2, the first distance Y1, the third distance Y3, the fifth distance Y5 and the fourth distance Y4. This arrangement makes it possible to prevent the condition in which the cartridge 100 cannot be taken out of the apparatus body because the cover erroneous insertion blocking portion 30 becomes operative at the position apart from the insertion slot portion 3 by the second distance Y2 before when the body locking mechanism 600 which locks the cover member 200 with the apparatus body becomes operative.

Here, in a case where the cover member 200 and the apparatus body 1*a* are configured to be always unlockable, there is a possibility that the operator erroneously removes the cover member 200 out of the apparatus body 1*a* while inserting the cartridge 100. In the case where the cover member 200 is removed out of the apparatus body 1*a* while inserting the cartridge 100, the insert operation cannot be made smoothly because the cartridge 100 is not guided by the cover member 200. Meanwhile, according to the present embodiment, the fourth distance Y4 is set at least at the position where the center of gravity of the cartridge 100 is located in the apparatus body 1*a*. Therefore, even if the cover member 200 is unlocked from the apparatus body 1*a* in this condition, it is possible to suppress the cartridge 100 from falling out of the apparatus body 1*a*. Then, after that, the cartridge 100 can be guided by the guide rail 410 of the apparatus body 1*a*, and the insert operation can be made smoothly.

According to the image forming apparatus 1 of the present embodiment, the cover member 200 is unlocked from the cartridge 100 by disposing the cover member 200 and the cartridge 100 at the reference position. This arrangement makes it possible to unlock the cover member 200 and the cartridge 100 without making another operation.

While the case of suppressing the erroneous insertion by differentiating the shapes of the first channel portion 31 and the second channel portion 21 of the apparatus body 1*a* has been described in the image forming apparatus 1 of the embodiment described above, the present disclosure is not limited to such configuration. For instance, an arrangement is made so as to restrict erroneous insertion by differentiating the shapes of the cover member 200 and the cartridge 100.

Still further, while the case in which a number of both of the cover-side project portion 33 and the first channel portion 31 is one has been described in the image forming apparatus 1 of the present embodiment described above, the number is not limited to be one. For instance, as illustrated in FIGS. 20A and 20B, it may be arranged such that four ribs are provided in the first channel portion 31 and one cover-side project portion 33 is divided into four parts so as to remove unnecessary parts, respectively. In this case, as illustrated in FIGS. 21A through 22C for example, it is possible to make six combination patterns by removing two parts among four parts of the first channel portion 31 and one cover-side project portion 33, respectively. As for the combinations of the cover member and the apparatus body having six different functions, this arrangement makes it possible to suppress other types of combinations and to commonly use the cover member for many types of cartridges.

According to the present disclosure, the first cover erroneous insertion blocking portion restricts the cover member of the second drum cartridge compatible with the second apparatus body functionally different from the first apparatus body from being guided by the holding portion in the range exceeding the second distance which is shorter than the first distance. This arrangement makes it possible to suppress the drum cartridge incompatible with the apparatus body from being erroneously inserted.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-110448, filed on Jun. 2, 2017, which is hereby incorporated by reference herein in its entirety.

What is claimed is:

1. A cartridge unit comprising:

a drum cartridge comprising a photosensitive drum for forming an image, the drum cartridge including a shape such that the drum cartridge is capable of being mounted to each of a plurality of image forming apparatuses having specifications that differ from each other, the drum cartridge being configured to be compatible in shape with a guide portion of a first image forming apparatus that is an image forming apparatus functionally compatible with the drum cartridge among the plurality of the image forming apparatuses having specifications that differ from each other so that the drum cartridge is capable of being inserted into the first image forming apparatus in an insert direction and of being capable of being pulled out of the first image forming apparatus in a pull-out direction opposite to the insert direction;

a cover member removably attached with the drum cartridge and configured to shade the photosensitive drum, the cover member being configured to be compatible in shape with a holding portion of the first image forming apparatus so that the cover member is guided and held by the holding portion;

a stopper provided on the cover member and configured to restrict the cover member from being inserted beyond a first distance from an insertion slot portion of the first image forming apparatus;

a lock member provided on the cover member, the lock member being configured to lock the cover member with the first image forming apparatus in a case that the drum cartridge slides with respect to the cover member in the insert direction in a condition in which the cover member, being inserted by the first distance from the insertion slot portion of the first image forming apparatus, is restricted from further moving in the insert direction by the stopper, and a cover erroneous insertion blocking portion provided on the cover member, the cover erroneous insertion blocking portion being configured to permit the cover member to be guided by the holding portion by the first distance from the insertion slot portion of the first image forming apparatus, and the cover erroneous insertion blocking portion being configured to block the cover member from being inserted beyond a second distance shorter than the first distance from an insertion slot portion of a second image forming apparatus in a case where the cover member is inserted into the second image forming apparatus.

2. The cartridge unit according to claim 1, wherein the lock member is configured to lock the cover member with the first image forming apparatus if the drum cartridge is inserted into the first image forming apparatus by a third distance that is longer than the first distance from the insertion slot portion in a condition in which the cover member is held by the holding portion, and wherein the lock member is configured to be unlocked from the first image forming apparatus if the drum cartridge is inserted into the first image forming apparatus by a fourth distance that is longer than the third distance from the insertion slot portion of the first image forming apparatus.

3. The cartridge unit according to claim 2, further comprising a cartridge erroneous insertion blocking portion provided on the drum cartridge and configured to block the drum cartridge from being inserted into the second image forming apparatus, wherein the drum cartridge is configured to be blocked from being inserted into the apparatus by the cartridge erroneous insertion blocking portion in a range exceeding a fifth distance that is longer than the first distance and is shorter than the third distance from the insertion slot portion of the first image forming apparatus.

4. The cartridge unit according to claim 1, further comprising a unit lock mechanism configured to lock and unlock the drum cartridge with/from the cover member, wherein the unit lock mechanism unlocks the drum cartridge from the first cover member in a case where the drum cartridge covered by the cover member and the drum cartridge is inserted by the first distance from the insertion slot portion of the first image forming apparatus.

5. The cartridge unit according to claim 4, wherein the unit lock mechanism comprises:

an engage portion provided in the cover member, the engage portion being engageable with an engaged portion provided in the first image forming apparatus, a moving unit provided with the engage portion and disposed movably with respect to the cover member, a protrusion provided in the moving unit and configured to protrude toward the drum cartridge covered by the cover member, and a lock portion engageable with the protrusion, the lock portion being configured to lock the drum cartridge with the cover member in a condition in which the lock portion is engaged with the protrusion, and to unlock the protrusion in response to a movement of the moving unit as the drum cartridge covered by the cover member is inserted by a predetermined distance from the insertion slot portion of the first image forming apparatus and the engage portion engages with the engaged portion.

6. The cartridge unit according to claim 1, wherein the drum cartridge is detachably mountable to the first image forming apparatus along a rotational axis direction of the photosensitive drum.

7. The cartridge unit according to claim 1, wherein the photosensitive drum is connected with a drive transmission portion of the first image forming apparatus by the drum cartridge being mounted to the first image forming apparatus.

* * * * *